US009581934B2

(12) United States Patent
Ito et al.

(10) Patent No.: US 9,581,934 B2
(45) Date of Patent: Feb. 28, 2017

(54) DEVELOPING APPARATUS, DEVELOPING METHOD, IMAGE FORMING APPARATUS, AND IMAGE FORMING METHOD

(71) Applicant: CANON KABUSHIKI KAISHA, Tokyo (JP)

(72) Inventors: Minoru Ito, Susono (JP); Masaki Yamada, Mishima (JP); Kazuhito Wakabayashi, Mishima (JP); Tomoya Uesugi, Susono (JP); Michihisa Magome, Mishima (JP); Takashi Matsui, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/573,375

(22) Filed: Dec. 17, 2014

(65) Prior Publication Data

US 2015/0185656 A1 Jul. 2, 2015

(30) Foreign Application Priority Data

Dec. 26, 2013 (JP) ..... 2013-269605

(51) Int. Cl.
*G03G 15/08* (2006.01)
*G03G 9/00* (2006.01)

(52) U.S. Cl.
CPC ..... *G03G 15/0818* (2013.01); *G03G 9/00* (2013.01)

(58) Field of Classification Search
CPC ..... G03G 15/0808; G03G 15/0818
See application file for complete search history.

(56) References Cited

U.S. PATENT DOCUMENTS 6,650,853 B1 * 11/2003 Sumikawa ..... G03G 15/22 399/147
2002/0009313 A1 * 1/2002 Okamura ..... G03G 15/065 399/286

(Continued)

FOREIGN PATENT DOCUMENTS

JP 57-5047 A 1/1982
JP 2002-23485 A 1/2002

OTHER PUBLICATIONS

U.S. Appl. No. 14/571,683, filed Dec. 16, 2014. Inventor: Wakabayashi, et al.

(Continued)

*Primary Examiner* — Erika J Villaluna
(74) *Attorney, Agent, or Firm* — Fitzpatrick, Cella, Harper & Scinto

(57) ABSTRACT

The developing apparatus includes a toner, a developing container, a developing roller, and a toner layer thickness controlling member, wherein the toner contains toner particles containing a binder resin and a colorant, and silica fine particles; the covering rate X1 of the surface of each of the toner particles with the silica fine particles is 40.0 to 75.0 area %; and a diffusion index represented by X1/X2 satisfies a predetermined range where the theoretical covering rate with the silica fine particles is defined as X2, the developing roller includes a substrate, a base layer, and a coverage portion; and the volume resistivity of the coverage portion and the average thickness of the coverage portion are within predetermined ranges.

12 Claims, 7 Drawing Sheets

(56) References Cited

U.S. PATENT DOCUMENTS

| | | | | |
|---|---|---|---|---|
| 2008/0292366 | A1* | 11/2008 | Akama | G03G 15/0818 399/286 |
| 2015/0064617 | A1 | 3/2015 | Magome et al. | |

OTHER PUBLICATIONS

U.S. Appl. No. 14/568,061, filed Dec. 11, 2014. Inventor: Magome, et al.
U.S. Appl. No. 14/568,058, filed Dec. 11, 2014. Inventor: Matsui, et al.
U.S. Appl. No. 14/568,062, filed Dec. 11, 2014. Inventor: Magome, et al.
U.S. Appl. No. 14/571,167, filed Dec. 15, 2014. Inventor: Matsui, et al.
U.S. Appl. No. 14/575,848, filed Dec. 18, 2014. Inventor: Uratani, et al.

* cited by examiner

DEVELOPING APPARATUS, DEVELOPING METHOD, IMAGE FORMING APPARATUS, AND IMAGE FORMING METHOD

BACKGROUND OF THE INVENTION

Field of the Invention

The present invention relates to a developing apparatus, a developing method, an image forming apparatus, and an image forming method.

Description of the Related Art

Higher quality of electrophotographic images has been required, and suppression of generation of "fogging" caused by toners adhering to non-image portions of electrophotographic images has been required.

A reduction in size of image forming apparatuses has recently been required. One of effective measures to satisfy this requirement is a reduction in size of a developing apparatus, which occupies a considerable volume of an image forming apparatus.

One specific method of achieving a reduction in size of the developing apparatus is use of a system without a cleaner for an electrophotographic photosensitive member (hereinafter also referred to as a "cleaner-less system"). In such a system without the cleaner for an electrophotographic photosensitive member, however, a toner adhering onto non-developed portions, e.g., non-electrostatic latent image portions of the electrophotographic photosensitive member and remain on the electrophotographic photosensitive member even after a transferring step may adhere to a charging member and contaminate the charging member. Accordingly, adhesion of the toner to non-developed portions of the electrophotographic photosensitive member should be suppressed more significantly to attain formation of electrophotographic images with higher quality in the cleaner-less system.

Japanese Patent Application Laid-Open No. 2002-23485 discloses techniques for providing good images by way of a developing roller including a second resin coating layer of $10^{10}$ Ω·cm or more not containing an electro-conductive fine particle on a first resin coating layer of $10^{6}$ Ω·cm or less.

The present inventors, who have conducted extensive research, have found that when the developing roller described in Japanese Patent Application Laid-Open No. 2002-23485 is used, adhesion of a toner to non-developed portions of the electrophotographic photosensitive member may be effectively suppressed. This is probably because the developing roller described in Japanese Patent Application Laid-Open No. 2002-23485 has a layer having high electric resistance on the surface thereof. Due to the high electric resistance of the developing roller, charges applied to the toner present between an electrophotographic photosensitive member and the developing roller barely leak to the side of the developing roller, so that the toner can keep high charge.

Unfortunately, the present inventors have conducted further research and found that the developing roller may insufficiently control the amount of the toner to be conveyed by the developing roller with a toner layer thickness controlling member under low humidity environments in which the toner readily undergoes friction charge (hereinafter this phenomenon is referred to insufficient control). Namely, the insufficient control is probably caused for the following reasons 1) and/or 2):

1) The electric resistance of the surface of the developing roller provides excessively high charges of the toner carried on the developing roller, and the highly charged toner attracts the toner not carried on the developing roller by an electrical attractive force.

2) The excessively charged toner adheres to the surface of the developing roller due to an image force to roughen the surface of the developing roller, so that an unintendedly large amount of the toner is disposed on the developing roller.

Such insufficient control may cause defects called ghost and spotted or wavy unevenness of non-image portions in electrophotographic images.

SUMMARY OF THE INVENTION

The present invention is directed to providing a developing apparatus and a developing method that can stably form high-quality electrophotographic images under a variety of environments in which the charging properties of a toner fluctuate. Further, the present invention is directed to providing an image forming apparatus and an image forming method that can stably form high-quality images under a variety of environments.

According to one aspect of the present invention, there is provided a developing apparatus comprising a toner, a developing container accommodating the toner, a developing roller rotatably held, the developing roller carrying the toner fed from the developing container on the surface of the developing roller to form a toner layer and conveying the toner layer, and a toner layer thickness controlling member controlling the thickness of the toner layer, wherein the toner contains toner particles containing a binder resin and a colorant, and silica fine particles, a covering rate X1 of the surface of each of the toner particles with the silica fine particles, which is determined with an X-ray electron spectroscope for chemical analysis (ESCA), is 40.0 area % or more and 75.0 area % or less, a diffusion index represented by Expression 1 satisfies Expression 2:

$$\text{diffusion index} = X1/X2 \quad \text{(Expression 1)}$$

$$\text{diffusion index} \geq -0.0042 \times X1 + 0.62 \quad \text{(Expression 2)}$$

where the theoretical covering rate with the silica fine particles is defined as $X2$, the developing roller includes a substrate, a base layer on the outer peripheral surface of the substrate, and a coverage portion disposed, directly or via another layer, on an outer periphery of the base layer, and the coverage portion has a volume resistivity of $1.0 \times 10^{8}$ Ω·cm or more, and has an average thickness of from 0.3 μm to 5.0 μm.

According to another aspect of the present invention, there is provided a developing method using the developing apparatus, the method including a step of contacting the developing roller with a region to be developed in which the developing roller faces an electrophotographic photosensitive member, conveying the toner, and developing an electrostatic latent image with the toner, the electrostatic latent image being formed on the electrophotographic photosensitive member.

According to further aspect of the present invention, there is provided an image forming apparatus including an electrophotographic photosensitive member, a charging unit charging the surface of the electrophotographic photosensitive member, an image exposure unit irradiating the charged surface of the electrophotographic photosensitive member with image exposing light to form an electrostatic latent image on the surface of the electrophotographic photosensitive member, a developing unit developing the electrostatic latent image formed on the surface of the electrophotographic photosensitive member to form a toner image on the surface of the electrophotographic photosensitive member, a transfer unit transferring the toner image formed on the surface of the electrophotographic photosensitive member onto a transfer material with or without an intermediate transferring member, and a fixing unit fixing the toner image transferred onto the transfer material on the transfer material, wherein the developing unit is the developing apparatus.

Further features of the present invention will become apparent from the following description of exemplary embodiments with reference to the attached drawings.

DESCRIPTION OF THE EMBODIMENTS

Figure 1:
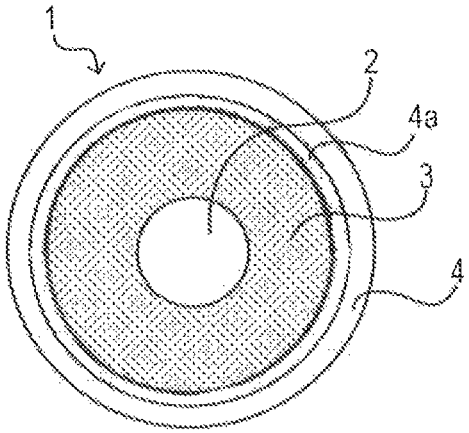
FIG. 1 is a cross sectional view illustrating an example of the developing roller according to the present invention.

Preferred embodiments of the present invention will now be described in detail in accordance with the accompanying drawings.

The present inventors have found that if a developing apparatus including a developing roller including a coverage portion having specific physical properties according to the present invention and a toner having controlled fluidity according to the present invention is used, generation of fogging and insufficient control can be suppressed even under high humidity environments and low humidity environments. The present inventors think the following reason.

First, fogging under a high temperature and high humidity environment will be described. To attain uniform charging properties under a high temperature and high humidity environment in which a toner is difficult to charge, the following two conditions should be satisfied. One is that the developing roller has high conductivity giving properties, and the other is that the toner is frequently charged.

The conductivity giving properties of the developing roller will be considered. The toner can be charged by contacting the developing roller by friction. Unfortunately, it has been found that simultaneously with the charging of the toner, the charge of the toner decays in a contacting portion between the toner and the developing roller (hereinafter also referred to as a "contacting portion"), and the toner is not sufficiently charged. As a result, a toner having wide distribution of the charging amount is present on the developing roller, increasing fogging.

The term "decay of the charge of the toner in the contacting portion" indicates that when the toner is present between the developing roller and a photosensive member and is present between the developing roller and the toner layer thickness controlling member, the charge of the toner leaks to the side of the developing roller to reduce the charge of the toner. As a result, the frictional charge of the toner (by tribo-charging) is not sufficiently increased, and a toner having a wide charge distribution is carried on the surface of the developing roller. For this reason, adhesion of the toner to non-developed portions of the electrophotographic photosensitive member (fogging) readily occurs.

Especially, the charge of the toner remarkably decays when the toner is present between the electrophotographic photosensitive member and the developing roller. It seems that although the charge of the toner decays also in the contact region between the developing roller and the toner layer thickness controlling member (hereinafter referred to as a control portion), the decay in this case barely affects fogging because frictional charge exceeding the amount of the decay is given to the toner.

For this reason, suppression of fogging should be attained by suppressing the decay of the charge of the toner in the contacting portion. Then, the present invention uses a developing roller having a coverage portion on the surface thereof, the coverage portion having a volume resistivity of $1.0\times10^{8}$ Ω·cm or more, and has an average thickness of from 0.3 μm to 5.0 μm (0.3 μm and 5.0 μm are both inclusive in the range). Thereby, the decay of the charge of the toner in the contacting portion can be suppressed.

The developing roller having portions with high electric resistance on its surface also suppresses the leakage of the charge from an excessively charged toner. For this reason, such a developing roller readily causes charge up of the toner, and hence the insufficient control under a low temperature and low humidity environment.

Then, the present inventors have examined the frequency of the charging of the toner.

Although the toner is conveyed by the developing roller to the region to be developed, a conveying force from the developing roller and a pressing force from the toner layer thickness controlling member act on the toner in the contact region between the developing roller and toner layer thickness controlling member. As a result, the toner on the surface of the developing roller is conveyed while particles of the toner are being circulated as if mixed together by stirring. Ideally, particles of the toner are sequentially being circulated in the contact region with the toner layer thickness controlling member to sequentially contact the developing roller, and the particles of the toner uniformly undergo friction to be uniformly charged.

Namely, it is important to well circulate the toner in the contact region between the developing roller and the toner layer thickness controlling member and increase the frequency of charging of the particles of the toner to uniformly charge the toner.

Accordingly, the toner according to the present invention is configured to have high fluidity to promote the circulation of the toner. Specifically, the toner according to the present invention is a toner containing toner particles containing a binder resin and a colorant, and silica fine particles, wherein a covering rate X1 of the surface of each of the toner particles with the silica fine particles, which is determined with an X-ray electron spectroscope for chemical analysis (ESCA), is 40.0 area % or more and 75.0 area % or less, a diffusion index represented by Expression 1 satisfies Expression 2:

diffusion index=$X1/X2$ (Expression 1)

diffusion index≥−0.0042×$X1$+0.62 where the theoretical covering rate with the silica fine particles is defined as $X2$. (Expression 2)

As a result, the toner according to the present invention can significantly suppress generation of fogging if the toner is used under a high temperature and high humidity environment or a low temperature and low humidity environment. The insufficient control caused by charge up can also be suppressed. Thereby, a developing apparatus that helps forming of high-quality electrophotographic images can be provided.

<Developing Apparatus, Image Forming Apparatus, and Image Forming Method>

The developing apparatus according to the present invention includes the toner, a developing container accommodating the toner, a developing roller rotatably held, the developing roller carrying the toner fed from the developing container on the surface of the developing roller to form a toner layer and conveying the toner layer, and a toner layer thickness controlling member controlling the thickness of the toner layer.

The image forming apparatus according to the present invention is an image forming apparatus including the developing apparatus. The image forming apparatus can include an electrophotographic photosensitive member, a charging unit charging the surface of the electrophotographic photosensitive member, an image exposure unit irradiating the charged surface of the electrophotographic photosensitive member with image exposing light to form an electrostatic latent image on the surface of the electrophotographic photosensitive member, the developing apparatus developing the electrostatic latent image formed on the surface of the electrophotographic photosensitive member to form a toner image on the surface of the electrophotographic photosensitive member, a transfer unit transferring the toner image formed on the surface of the electrophotographic photosensitive member onto a transfer material with or without an intermediate transferring member, and a fixing unit fixing the toner image transferred onto the transfer material on the transfer material.

The image forming method according to the present invention includes a step of developing with the developing apparatus by a developing method of contacting the developing roller with a region to be developed in which the developing roller faces an electrophotographic photosensitive member, conveying the toner, and developing an electrostatic latent image with the toner, the electrostatic latent image being formed on the electrophotographic photosensitive member. The image forming method can include a discharging step of charging the surface of an electrophotographic photosensitive member, an image exposure step of irradiating the charged surface of the electrophotographic photosensitive member with image exposing light to form an electrostatic latent image on the surface of the electrophotographic photosensitive member, the developing step of developing the electrostatic latent image formed on the surface of the electrophotographic photosensitive member to form a toner image on the surface of the electrophotographic photosensitive member, a transferring step of transferring the toner image formed on the surface of the electrophotographic photosensitive member onto a transfer material with or without an intermediate transferring member, and a fixing step of fixing the toner image transferred onto the transfer material on the transfer material.

Figure 2:
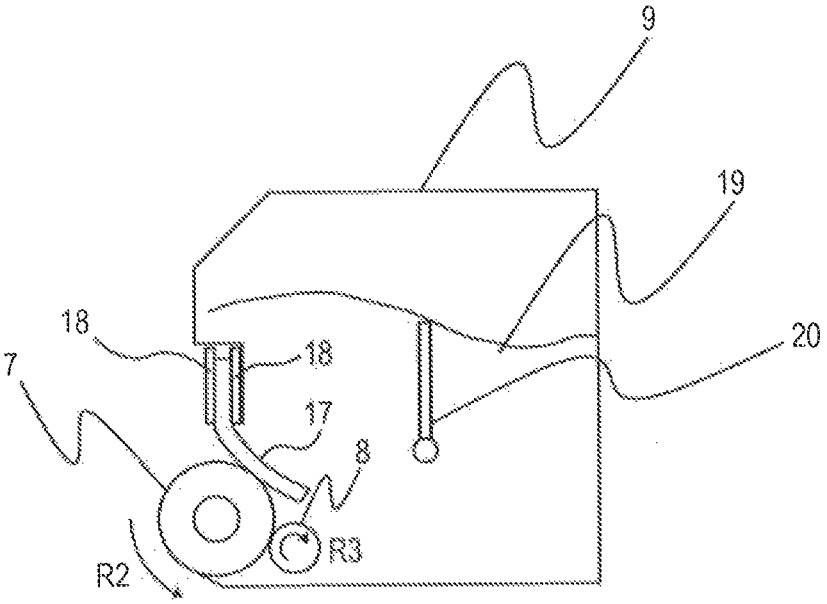
FIG. 2 is a cross sectional view illustrating an example of a developing apparatus according to the present invention.
Figure 3:
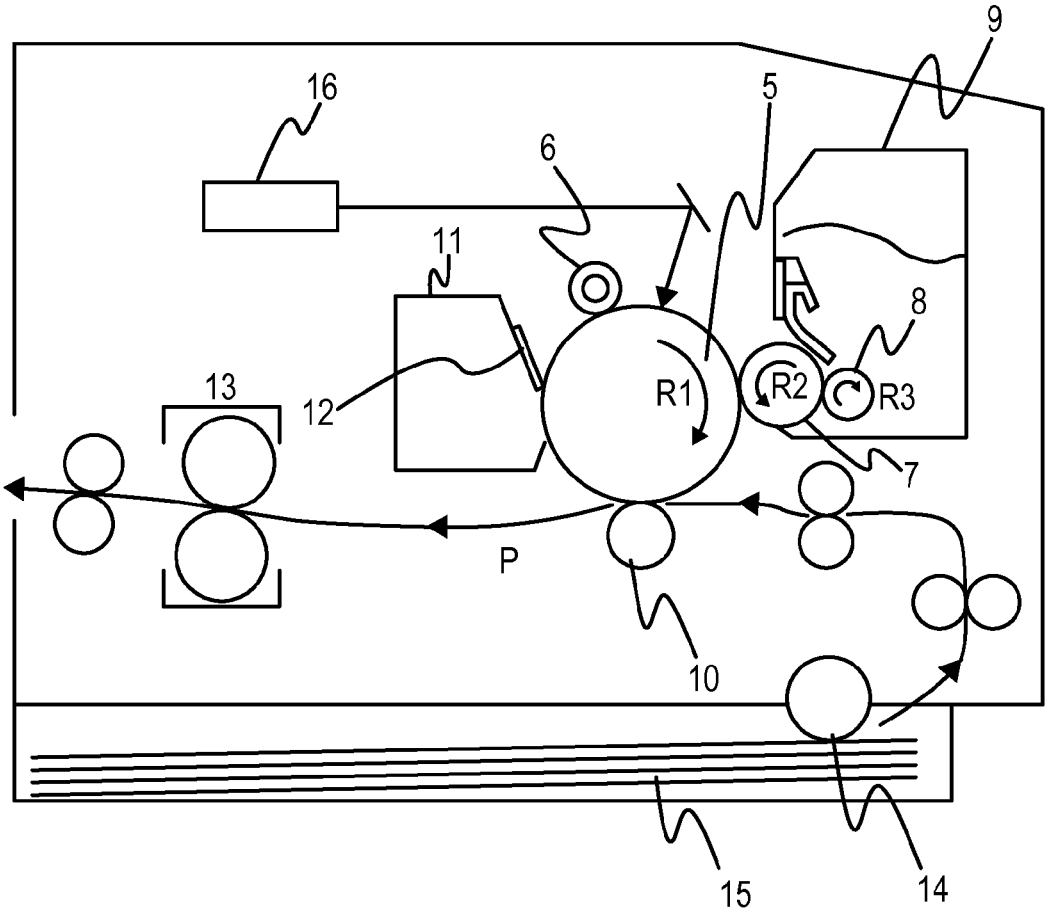
FIG. 3 is a cross sectional view illustrating an example of an image forming apparatus according to the present invention.

An example of the developing apparatus and the image forming apparatus according to the present invention will be described in detail with reference to the drawings, but the present invention will not be limited to these. FIG. 2 is a cross sectional view schematically illustrating an example of the developing apparatus according to the present invention. FIG. 3 is a cross sectional view schematically illustrating an example of an image forming apparatus in which the developing apparatus according to the present invention is incorporated.

In FIG. 2 or FIG. 3, an electrophotographic photosensitive member 5 is rotated in the direction of an arrow R1. The electrophotographic photosensitive member 5 is an image bearing member on which an electrostatic latent image is formed. A developing roller 7 rotates in the direction of an R2 to convey a toner 19 to a region to be developed in which the developing roller 7 faces the electrophotographic photosensitive member 5. The developing roller 7 is in contact with a toner feeding member 8 which feeds the toner 19 to the surface of the developing roller 7.

A charging roller 6, a transfer member (transfer roller) 10, a cleaner container 11, a cleaning blade 12, a fixing unit 13, a pick up roller 14, and the like are provided around the electrophotographic photosensitive member 5. The electrophotographic photosensitive member 5 is charged by the charging roller 6. The electrophotographic photosensitive member 5 is irradiated with laser light from a laser generating apparatus 16 to perform exposure. This forms an electrostatic latent image corresponding to a target image. The electrostatic latent image on the electrophotographic photosensitive member 5 is developed with the toner 19 in the developing apparatus 9 to form a toner image. The toner image is transferred onto a transfer material (paper) 15 by a transfer member (transfer roller) 10, which contacts the electrophotographic photosensitive member 5 with the transfer material (paper) 15 being interposed. The transfer material (paper) 15 carrying the toner image is conveyed to the fixing unit 13, and the toner image is fixed on the transfer material (paper) 15. The toner 19 partially remaining on the electrophotographic photosensitive member 5 is scraped with a cleaning blade 12, and is accommodated in the cleaner container 11.

Figure 4:
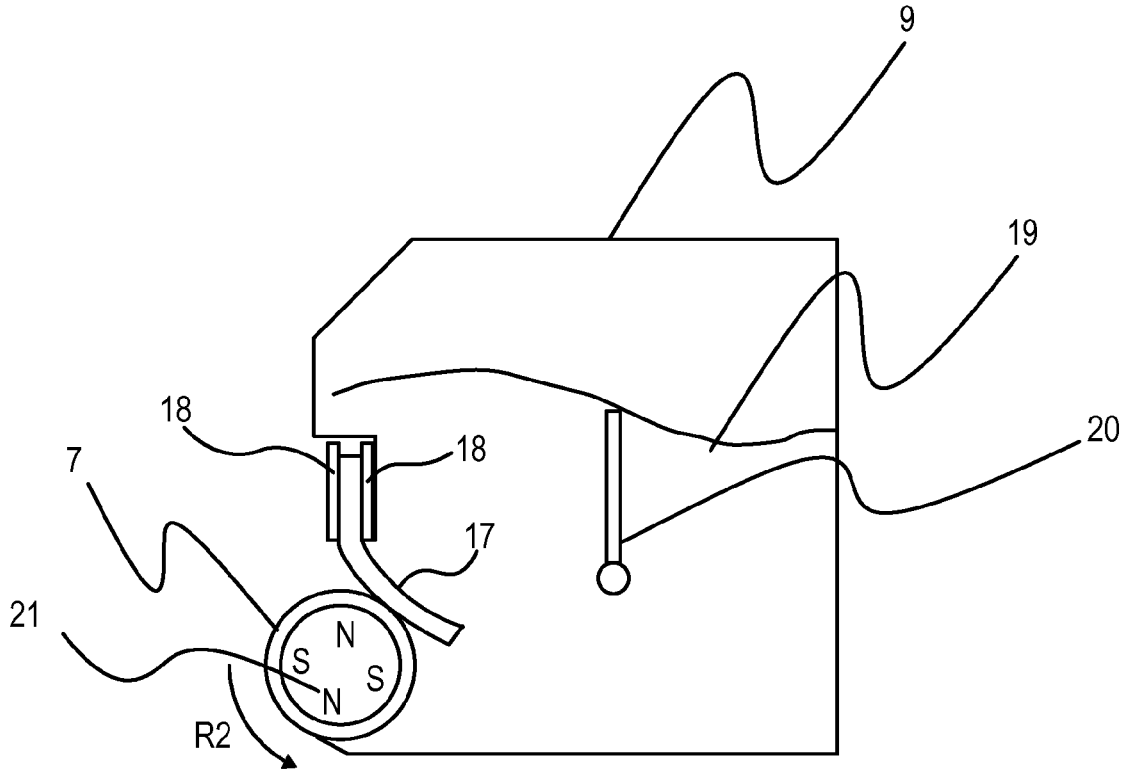
FIG. 4 is a cross sectional view illustrating an example of the developing apparatus according to the present invention.

FIG. 4 is a cross sectional view schematically illustrating another example of the developing apparatus according to the present invention. As illustrated in FIG. 4, a developing apparatus 9 not including a toner feeding member 8 and including a magnet roller 21 can also be used.

In the image forming method using the developing apparatus according to the present invention, the discharging step can use a contact charging apparatus in which the electrophotographic photosensitive member can contact the charging roller to form a contact region, and a predetermined charging bias is applied to the charging roller to charge the surface of the electrophotographic photosensitive member at a predetermined polarity and a predetermined potential. Such contact charging can stably and uniformly charge the surface of the electrophotographic photosensitive member and can reduce generation of ozone. To keep the contact with the electrophotographic photosensitive member uniform and perform uniform charging, a charging roller rotating in the same direction as the electrophotographic photosensitive member can be used.

The contact pressure of the charging roller can be 4.9 N/m or more and 490.0 N/m or less. DC voltage or DC voltage superimposed with AC voltage can be used. When AC voltage is superimposed, AC voltage can be 0.5 kVpp or more and 5.0 kVpp or less, AC frequency can be 50 Hz or more and 5 kHz or less, and the absolute value of DC voltage can be 200 V or more and 1500 V or less.

Examples of the charging roller include rollers including an elastic layer disposed on a core metal. Examples of materials for the elastic layer include rubber materials such as ethylene-propylene-diene (EPDM), polyethylene, polyurethane, butadiene acrylonitrile rubber (NBR), silicone rubber, and isoprene rubber in which conductive substances such as carbon black and metal oxide are dispersed to adjust resistance, or foamed materials thereof. These may be used singly or in combinations of two or more. Resistance can be adjusted without any dispersed conductive substance or by use of an ionic conductive material in combination. Examples of the core metal include aluminum and SUS. The charging roller is arranged to be pressed at a predetermined pressure against the elasticity of a charged member, i.e., the electrophotographic photosensitive member to form a contact charging region which is a contact region between the charging roller and the electrophotographic photosensitive member.

Next, a contact transferring step in an image forming method using the developing apparatus according to the present invention will be specifically described. In the contact transferring step, a toner image is electrostatically transferred onto a recording medium while the electrophotographic photosensitive member is in contact with a transfer member through the recording medium and a voltage having a polarity opposite to that of the toner is applied to the transfer member. The contact pressure of the transfer member is preferably 2.9 N/m or more, more preferably 19.6 N/m or more in terms of line pressure. A contact pressure of 2.9 N/m or more in terms of line pressure can suppress deviation of the recording medium during conveyance and transfer deficits.

In the present invention, the toner layer thickness controlling member is brought into contact with the developing roller through the toner to control the thickness of the toner on the developing roller. Thereby, high-quality images without fogging can be attained. The toner layer thickness controlling member contacting the developing roller can be a control blade.

Examples of the material for the control blade include rubber elastic materials such as silicone rubber, urethane rubber, and NBR; synthetic resin elastic materials such as polyethylene terephthalate; metal elastic materials such as phosphor bronze plates and SUS plates; and composite member thereof. Furthermore, to control the charging properties of the toner, a charge controlling substance such as resin, rubber, metal oxide, or metal may be applied to an elastic support such as a rubber, synthetic resin, or metal elastic materials so as to contact the contact region of the developing roller. Among these, control blades formed of metal elastic materials and having a resin or rubber bonded thereto so as to contact the contact region of the developing roller can be used. The resins or rubbers bonded to the metal elastic materials can be resins or rubbers readily positively charged, such as urethane rubber, urethane resin, polyamide resin, and nylon resin.

The base of the control blade, which is an upper portion thereof, is fixed and held on the side of the developing apparatus. A lower portion of the control blade is bent against its elastic force in the forward direction or the opposite direction of the developing roller to contact the control blade with the surface of the developing roller at a proper elastic pressure.

The contact pressure between the control blade and the developing roller is preferably 2.94 N/m or more and 245.00 N/m or less, more preferably 4.9 N/m or more and 118.0 N/m or less in terms of the line pressure in the generating line direction of the developing roller. At a contact pressure of 2.94 N/m or more, the toner can be uniformly applied, and fogging and scattering can be suppressed. At a contact pressure of 245 N/m or less, the pressure applied to the toner can be reduced to suppress degradation of the toner.

The amount of the toner layer on the developing roller is preferably 2.0 $g/m^2$ or more and 12.0 $g/m^2$ or less. The amount is more preferably 3.0 $g/m^2$ or more and 10.0 $g/m^2$ or less. At an amount of the toner on the developing roller of 2.0 $g/m^2$ or more, sufficient image density is attained. At an amount of the toner on the developing roller of 12.0 $g/m^2$ or less, generation of the insufficient control can be suppressed. Furthermore, fogging can be reduced without impairing uniform charging properties.

In the present invention, the amount of the toner on the developing roller can be arbitrarily varied according to the surface roughness (Ra) of the developing roller, the free length of the toner layer thickness controlling member, and the contact pressure of the toner layer thickness controlling member. The amount of the toner on the developing roller is measured by the following method. A cylindrical filter paper is mounted on a suction piece having an outer diameter of 6.5 mm. The suction piece is mounted on a vacuum. The toner on the developing roller is suctioned by aspiration with the vacuum. The amount of the suctioned toner (g) is divided by the area ($m^2$). The value is defined as the amount of the toner on the developing roller.

In the developing step in the image forming method using the developing apparatus according to the present invention, a contact developing apparatus can be used, in which the electrophotographic photosensitive member and the developing roller contact to form a contact region, and a predetermined developing bias is applied to the developing roller to develop the electrophotographic photosensitive member. Such contact development can attain stable and uniform development. To keep the contact with the electrophotographic photosensitive member uniform and perform uniform development, a developing roller rotating in the same direction as that of the electrophotographic photosensitive member can be used.

Superimposed DC voltage can be applied to the developing roller. The DC voltage, if superimposed, can be applied according to the potential on the electrophotographic photosensitive member, and the absolute value of the DC voltage can be 200 V or more and 500 V or less. An absolute value of 200 V or more attains a great difference between the absolute value of the DC voltage and the absolute value of the potential of portions having low potential on the electrophotographic photosensitive member to facilitate formation of images of portions having low potential. An absolute value of 500 V or less attains uniform images without further increasing the potential of portions having a high absolute value of potential on the electrophotographic photosensitive member.

In a latent image forming step in the image forming method using the developing apparatus according to the present invention, a latent image can be formed by disposing portions having a high absolute value of potential and portions having a low absolute value of potential on the electrophotographic photosensitive member. The polarity of the potential on the electrophotographic photosensitive member may be set according to the properties of the electrophotographic photosensitive member. The potential has the same polarity as that of the DC voltage to be applied to the developing roller. A voltage to be applied to the developing roller can be set between the potential having a high absolute value and the potential having a low absolute value. The portions having a high absolute value of potential can have an absolute value of potential of 400 V or more and 800 V or less. If the portions having a high absolute value of potential have an absolute value of potential of 400 V or more, a wide range of the potential of the portions having a low absolute value of potential and a wide range of the DC voltage to be applied to the developing roller can be set to facilitate development utilizing the difference in voltage. As a result, density is increased and fogging is reduced. If the portions having a high absolute value of potential have an absolute value of potential of 800 V or less, an excessive charging bias does not need to be applied to the charging roller and the voltage to be applied to the developing roller can be reduced. As a result, leakage barely occurs between the developing roller and the electrophotographic photosensitive member. The portions having a low absolute value of potential can have an absolute value of potential of 0 V or more and 200 V or less. If the portions having a low absolute value of potential have an absolute value of potential of 0 V or more, the potential can be stably set to attain stable images. If the portions having a high absolute value of potential have an absolute value of potential of 200 V or less, stable images can be attained without further increasing the potential in the portions having a high absolute value of potential.

For example, when a negatively charged electrophotographic photosensitive member is used in the cleaner-less system, a DC voltage of −100 V can be applied to a black portion, a DV voltage of −600 V can be applied to a white portion, and a DC voltage of −300 V can be applied to the developing roller to attain well balanced images. The cleaner-less system, in particular, can have a great difference between the potential of the white portion on the electrostatic latent image and the DC voltage of the developing roller (hereinafter referred to as Vback). If the toner scattered on white portions is conveyed to the charging roller without being recovered, the toner causes charging deficits in the white portion on the electrostatic latent image on the electrophotographic photosensitive member on which the toner is present. At this time, a great Vback prevents the toner from appearing on the image to be formed. Unfortunately, a great Vback readily increases fogging. Accordingly, at a great Vback, the quality of the image can be improved by setting other conditions so as to reduce fogging.

The difference between the circumferential speed of the electrophotographic photosensitive member and that of the developing roller can be 100% or more and 170% or less. The contact pressure applied to the electrophotographic photosensitive member by the developing roller can be 0.00 N/m or more and 245.00 N/m or less as a guideline. If the difference in the circumferential speed and the contact pressure to the photosensitive member is controlled within the numeric values in the range, the electrostatic latent image on the electrophotographic photosensitive member can be well developed in the region to be developed.

[Developing Member (Developing Roller)]

One embodiment of a developing roller included in the developing apparatus according to the present invention is illustrated in FIG. 1. A developing roller 1 illustrated in FIG. 1 includes a solid cylindrical or hollow cylindrical conductive substrate 2 and a base layer 3 disposed on the outer peripheral surface of the substrate 2. The outer peripheral surface of the base layer 3 is coated with a coverage portion 4.

<Substrate>

The substrate 2 functions as an electrode and supporting member for the developing roller 1. The substrate 2 is formed of a metal or an alloy such as aluminum, copper alloys, and stainless steel; iron plated with chromium or nickel; or a conductive material such as synthetic resins having conductivity.

<Base Layer>

The base layer 3 allows the surface of the developing roller 1 to have elasticity needed so that the pressure is not excessively applied to the toner in the contact portion between the developing roller 1 and the electrophotographic photosensitive member 5 through the toner.

The base layer 3 can be formed of a molded rubber material. Examples of the rubber material include: ethylene-propylene-diene copolymerization rubber (EPDM), acrylonitrile-butadiene rubber (NBR), chloroprene rubber (CR), natural rubber (NR), isoprene rubber (IR), styrene-butadiene rubber (SBR), fluorine rubber, silicone rubber, epichlorohydrin rubber, hydride of NBR, and urethane rubber. These may be used singly or in combinations of two or more.

Among these, the material for the base layer 3 can be silicone rubber because silicone rubber barely causes compression set on the base layer 3 when another member (such as a toner layer thickness controlling member 17) is in contact with the developing member. Examples of silicone rubber include cured materials of addition-cured silicone rubber. Cured materials of addition-cured dimethyl silicone rubber in particular can be used because these have high adhesiveness to the coverage portion 4 and an intermediate layer described later.

The base layer 3 can appropriately contain a variety of additives such as a conductive agent, a non-conductive filler, a crosslinking agent, and a catalyst. The conductive agent can be fine particles of carbon black; conductive metals such as aluminum, and copper; and conductive metal oxides such as zinc oxide, tin oxide, and titanium oxide. Among these, carbon black is preferred because it is relatively readily available and attains high conductivity. When carbon black is used as the conductive agent, 2 to 50 parts by mass of carbon black can be compounded based on 100 parts by mass of rubber in the rubber material. Examples of the non-conductive filler include silica, quartz powder, titanium oxide, zinc oxide, or calcium carbonate. Examples of the crosslinking agent include di-t-butyl peroxide, 2,5-dimethyl-2,5-di(t-butylperoxy)hexane, or dicumyl peroxide. These may be used singly or in combinations of two or more.

<Coverage Portion>

The coverage portion 4 is needed to prevent the charge of the toner from escaping through the base layer 3 from the substrate 2. The coverage portion 4 has a volume resistivity of $1.0\times10^{8}$ Ω·cm or more. At a volume resistivity of $1.0\times10^{8}$ Ω·cm or more, the charge can be significantly prevented from escaping from the substrate 2. The materials for the coverage portion 4 can be organic resins or alumina. The organic resins can be urethane resin, silicone resin, carbonate resin, polyester resin, acrylic resin, and polyolefin resin. These may be used singly or in combinations of two or more. These resins may have their own fundamental skeletons. The resins may have a side chain or a functional group of any structure as long as the volume resistivity and the thickness of the coverage portion fall within the ranges specified above. These resins facilitate preparation of a structure having a volume resistivity of $1.0\times10^{8}$ Ω·cm or more and attain high film forming properties and high adhesion to an undercoat layer. When the material for the coverage portion is alumina, the volume resistivity is preferably $1.0\times10^{10}$ Ω·cm or more, more preferably $5.0\times10^{10}$ Ω·cm or more. When the material for the coverage portion is the organic resin, the volume resistivity is preferably $1.0\times10^{12}$ Ω·cm or more, more preferably $1.0\times10^{13}$ Ω·cm or more. A preferred range of the volume resistivity of the alumina is different from that of the organic resin because alumina has particularly strong negative charging properties. If some of charges are lost, alumina gives a large amount of charges due to its strong negative charging properties to compensate for the loss.

The average thickness of the coverage portion is 0.3 μm or more and 5.0 μm or less. At an average thickness of the coverage portion of 0.3 μm or more, an effect of preventing escape of the charge of the toner can be exerted. At an average thickness of the coverage portion of 5.0 μm or less, voltage is readily applied from the side of the developing roller to attain sufficient image density. The average thickness of the coverage portion is preferably 0.5 μm or more and 4.5 μm or less, more preferably 1.0 μm or more and 4.0 μm or less.

The coverage portion can be disposed over the entire layer disposed immediately under the coverage portion. The effect of preventing escape of the charge of the toner is demonstrated also when the coverage portion is disposed over part of the layer. This is probably because the charge of the toner does not decay at once but decays little by little when the toner rolls on a layer having low resistance on the developing roller. Namely, the coverage portion disposed over part of the layer having low resistance reduces the frequency of the toner rolling on the layer having low resistance to suppress decay of the charge. The coverage portion is disposed over preferably 30.0 area % or more, more preferably 50.0 area % or more, still more preferably 80.0 area % or more of the layer disposed immediately under the coverage portion. If the coverage portion is disposed over 30.0 area % or more of the layer disposed immediately under the coverage portion, the frequency of the decay of the charge of the toner can be suppressed to reduce fogging.

The coverage portion may contain a filler other than the resin. A variety of additives such as a conductive agent, a non-conductive filler, a crosslinking agent, and a catalyst are properly compounded. For the conductive agent, fine particles of carbon black, conductive metals (such as aluminum and copper), and conductive metal oxides such as zinc oxide, tin oxide, and titanium oxide can be used. The conductive agent can be added such that the volume resistivity of the coverage portion is $1.0\times10^{8}$ Ω·cm or more. When the conductive agent is used, 0.01 parts by mass or more and 3.00 parts by mass or less of the conductive agent can be compounded based on 100 parts by mass of the main material for the coverage portion. Examples of the non-conductive filler include silica, quartz powder, titanium oxide, zinc oxide, and calcium carbonate. These may be used singly or in combinations of two or more.

Examples of a method of forming a coverage portion include, but should not be limited to, spraying, immersion, or roll coating with a coating material when the material for the coverage portion is an organic resin. For example, Japanese Patent Application Laid-Open No. S57-5047 describes an immersion coating method in which a coating material is overflowed from the upper end of an immersion tank. This method is simple and has high production stability. An alumina film of the coverage portion can be formed by deposition, electrolytic plating, electroless plating, spraying of a coating material, immersion, or roll coating. A method that barely generates crack, such as deposition and plating, can be used as the method of forming an alumina film.

<Intermediate Layer>

One or more intermediate layers 4*a* can be disposed between the base layer 3 and the coverage portion 4 to attain a developing roller having a suitable surface shape that controls the amount of the toner to be conveyed. The intermediate layer 4*a* can contain at least a resin, an electroconductive particle, and a roughening particle. Furthermore, the intermediate layer 4*a* also blocks seep of oil to the surface of the base layer 3 if the oil seeps from the base layer 3.

Examples of the material for the resin used in the intermediate layer include the following binder resins: urethane resins, acrylic urethane resins, epoxy resins, diallyl phthalate resins, polycarbonate resins, fluorine resins, polypropylene resins, urea resins, melamine resins, silicon resins, polyester resins, polystyrene resins, vinyl acetate resins, phenol resins, polyamide resins, cellulose resins, silicone resins, polyolefin resins, and aqueous resins. These may be used singly or in combinations of two or more. Among these, urethane resin and acrylic urethane resins containing a nitrogen compound can be used as the resin to control the charging of the toner. In particular, urethane resins prepared by a reaction of an isocyanate compound with polyol are more preferred as the resin.

Examples of the isocyanate compound include the followings: diphenylmethane-4,4'-diisocyanate, 1,5-naphthalene diisocyanate, 3,3'-dimethylbiphenyl-4,4'-diisocyanate, 4,4'-dicyclohexylmethane diisocyanate, p-phenylene diisocyanate, isophorone diisocyanate, carbodiimide modified diphenylmethane diisocyanate (MDI), xylylene diisocyanate, trimethylhexamethylene diisocyanate, tolylene diisocyanate, naphthylene diisocyanate, paraphenylene diisocyanate, hexamethylene diisocyanate, and polymethylenepolyphenyl polyisocyanate. These may be used as a mixture in any mixing proportion.

Examples of polyol include the followings: bifunctional polyols (diol) such as ethylene glycol, diethylene glycol, propylene glycol, dipropylene glycol, 1,4-butanediol, hexanediol, neopentyl glycol, 1,4-cyclohexanediol, 1,4-cyclohexanedimethanol, xylene glycol, and triethylene glycol; trifunctional polyols and polyols having 3 or more functionalites such as 1,1,1-trimethylolpropane, glycerin, pentaerythritol, and sorbitol; and high molecular weight polyethylene glycol, polypropylene glycol, ethylene oxide-propylene oxide block glycol prepared by addition of ethylene oxide and propylene oxide to diols and triols. These may be used as a mixture in any mixing proportion.

The developing roller having any surface roughness can be used. The surface roughness can be properly adjusted to ensure the conveyance of the toner and sufficient image density, thereby reducing ghost and uneven density to attain high-quality images. In the present invention, center line average roughness Ra specified in JIS B 0601:1994 Surface Roughness is preferably 0.3 μm or more and 5.0 μm or less, more preferably 0.5 μm or more and 4.0 μm or less. At Ra of 0.3 μm or more, a stable amount of the toner can be coated irrespective of the temperature to suppress a reduction in the quality of images such as a reduction in image density and ghost. At Ra of 5.0 μm or less, a reduction in the quality of images such as fogging and roughness of images can be suppressed.

When the developing roller needs to have a surface roughness, a roughening particle can be added to the intermediate layer to control roughness. The roughening particle can have a volume average particle diameter of 3 μm or more and 20 μm or less. The amount of the roughening particle to be added to the intermediate layer is 1 part by mass or more and 70 parts by mass or less based on 100 parts by mass of the resin solid content in the intermediate layer. Examples of the roughening particle include fine particles of polyurethane resin, polyester resin, polyether resin, polyamide resin, acrylic resin, and phenol resin. These may be used singly or in combinations of two or more.

The intermediate layer can have conductivity. Examples of a method of giving conductivity include addition of an ionic conductive agent and an electro-conductive particle. Among these, inexpensive electro-conductive particles having resistance barely changeable by environments are suitably used. Carbon black is more preferred from the viewpoint of conductivity giving properties and reinforcing properties. In particular, carbon black having a primary particle diameter of 18 nm or more and 50 nm or less and dibutyl phthalate number (DBP) of 50 ml/100 g or more and 160 ml/100 g or less is preferred because conductivity, hardness, and dispersibility are well balanced. The content of the conductive fine particles can be 10% by mass or more and 30% by mass or less based on 100 parts by mass of the resin component that forms the intermediate layer.

Examples of a method of forming the intermediate layer include, but should not be limited to, spraying, immersion, or roll coating of coating materials. The immersion coating method of overflowing a coating material from the top of an immersion tank described in Japanese Patent Application Laid-Open No. S57-5047 is simple and has high production stability. The developing roller according to the present invention can be used in any developing apparatus such as a non-contacting developing apparatus and a contacting developing apparatus using a magnetic one-component developer or a non-magnetic one-component developer and a developing apparatus using a two-component developer.

[Toner]

The toner according to the present invention contains toner particles containing a binder resin and a colorant, and silica fine particles, a covering rate X1 of the surface of each of the toner particles with the silica fine particles, which is determined with an X-ray electron spectroscope for chemical analysis (ESCA), is 40.0 area % or more and 75.0 area % or less, a diffusion index represented by Expression 1 satisfies Expression 2:

$$\text{diffusion index}=X1/X2 \quad \text{(Expression 1)}$$

$$\text{diffusion index}\geq -0.0042\times X1+0.62 \text{ where a theoretical covering rate with the silica fine particles is defined as } X2. \quad \text{(Expression 2)}$$

The present inventors have examined and found that use of such a toner can suppress fogging irrespective of environments in use. Electrostatic aggregation of the toner caused by excessive charging (hereinafter referred to as insufficient control) can also be suppressed. Here, the present inventors think that fogging is caused for the following reason.

When the toner cannot ensure sufficient fluidity, of the toner on the developing roller, part of the toner contacting the surface of the developing roller from the beginning can be sufficiently charged. In contrast, part of the toner not contacting the surface of the developing roller cannot be circulated and has no chance to contact the developing roller. For this reason, the part of the toner not contacting the surface of the developing roller barely has a chance to be charged, and passes through the contact region with the toner layer thickness controlling member (hereinafter referred to as a blade nip). As a result, the toner is readily unevenly charged, causing charge up, a phenomenon that the charge of the toner is partially increased. Moreover, the uneven charging of the toner generates a large amount of the reverse toner, increasing fogging.

The present inventors consider the points described below important for suppressing fogging even under severe evaluation conditions described above.

(1) firm application of an external additive to the toner particles, and (2) charging of each toner particle in the blade nip.

To attain (2) in particular, the present inventors think that the following three points are important.

(2-1) Releasing Properties of Toner

This indicates releasability of the toner from the developing roller.

(2-2) Circulating Properties of Toner

This indicates movability of the toner not contacting the developing roller or the toner layer thickness controlling member in cooperation with movement of the toner contacting the developing roller or the toner layer thickness controlling member.

(2-3) Disaggregation of Toner

This indicates disaggregation of the toner such that particles of the toner in the blade nip undergo friction one by one.

The present inventors have found that if these are attained at the same time, generation of fogging can be suppressed even under severe conditions where fogging readily occurs. In particular, the present inventors have found a close correlation between the "diffusion index" and "a phenomenon that particles of the toner readily disaggregate one by one even when the toner is degraded" described later, and have achieved the present invention.

The toner according to the present invention contains toner particles containing a binder resin and a colorant, and silica fine particles. The toner particles can be toner particles having negatively charging properties. In the toner according to the present invention, the "state of silica fine particles externally added" is specified as follows. In the toner according to the present invention, the covering rate X1 of the surface of each of the toner particles with silica fine particles determined with an X-ray electron spectroscope for chemical analysis (ESCA) is 40.0 area % or more and 75.0 area % or less, and the diffusion index represented by Expression 1 satisfies Expression 2.

$$\text{diffusion index}=X1/X2 \quad \text{(Expression 1)}$$

$$\text{diffusion index}\geq -0.0042\times X1+0.62 \text{ where the theoretical covering rate with silica fine particles is defined as } X2. \quad \text{(Expression 2)}$$

The covering rate X1 can be calculated from the ratio of the intensity of the Si element detected in measurement of the toner to the intensity of the Si element detected in measurement of only silica fine particles with the ESCA. The covering rate X1 indicates a proportion of the area of the surface of the toner particle actually coated with the silica fine particles to the area of the surface of the toner particle.

At a covering rate X1 of 40.0 area % or more and 75.0 area % or less, the fluidity and charging properties of the toner can be controlled in good states throughout the durability test. At a covering rate X1 of less than 40.0 area %, disaggregation of the toner described later cannot be sufficiently attained, so that fogging cannot be reduced under severe evaluation conditions. The covering rate X1 is preferably 45.0 area % or more and 70.0 area % or less, more preferably 50.0 area % or more and 60.0 area % or less.

The theoretical covering rate with silica fine particles X2 can be calculated using parts by mass of the silica fine particles based on 100 parts by mass of the toner particles and the diameters of the silica fine particles from Expression 4. X2 indicates a proportion of an area that can be theoretically coated with the surfaces of the toner particles.

$$\text{theoretical covering rate } X2 \text{ (area \%)} = 31/2/(2\pi)\times(dt/da)\times(\rho t/\rho a)\times C\times 100 \quad \text{(Expression 4)}$$

wherein da: number average particle diameter (D1) of primary particles of silica fine particles dt: mass average particle diameter (D4) of the toner, ρa: true specific gravity of the silica fine particles, ρt: true specific gravity of the toner, C: mass of the silica fine particles/mass of the toner (For C, the content of the silica fine particles in the toner described later is used).

The physical meaning of the diffusion index represented by (Expression 1) will now be described. The diffusion index indicates a divergence of the actually measured covering rate X1 from the theoretical covering rate X2. It is thought that the degree of divergence indicates the abundance of the silica fine particles vertically layered doubly or triply on the surfaces of the toner particles. Ideally the diffusion index is 1. In this case, the covering rate X1 corresponds to the theoretical covering rate X2, and the silica fine particles layered doubly or more does not exist at all. If the silica fine particles aggregate and exist on the surfaces of the toner particles as secondary particles, a divergence will generate between the actually measured covering rate and the theoretical covering rate to reduce the diffusion index. In other words, the diffusion index indicates the amount of the silica fine particles existing as secondary particles.

In the present invention, it is important that the diffusion index is in the range specified by Expression 2. The range is wider than that of the toner produced conventionally. A higher diffusion index indicates that among the silica fine particles on the surfaces of the toner particles, the amount of the silica fine particles existing as secondary particles is smaller and the amount of the silica fine particles existing as primary particles is larger. As described above, the upper limit of the diffusion index is 1. The present inventors have found that when the covering rate X1 and the diffusion index satisfy the range specified by Expression 2 at the same time, disaggregation of the toner during application of pressure can be significantly enhanced.

It has been thought that disaggregation of the toner can be enhanced by externally adding a large amount of an external additive having a small particle diameter of about several nanometers to increase the covering rate X1. In contrast, the present inventors have examined and clarified that the degree of disaggregation of the toner varies when the measurement is performed at the same covering rate X1 while the diffusion index is varied. The present inventors have clarified that the difference in the degree of disaggregation of the toner is more remarkable when the degree of disaggregation of the toner is measured while pressure is being applied. The present inventors think that particularly the behavior of the toner in the blade nip is reflected more significantly in the disaggregation of the toner during application of pressure. For this reason, the present inventors think that to more finely control the disaggregation of the toner during application of pressure, the diffusion index is important in addition to the covering rate X1.

When the covering rate X1 and the diffusion index satisfy the range specified by Expression 2 at the same time, the disaggregation of the toner is enhanced. Although the details are not clear, the present inventors presume the reason as follows. When the toner exists in a narrow place with high pressure such as in a blade nip, particles of the toner are "meshed" with each other so as to prevent collision of the external additive existing on the surfaces thereof. Probably, such a behavior of particles of the toner enhances the disaggregation of the toner. At this time, if a larger amount of the silica fine particles exists as secondary particles, influences by the meshing are excessively great, leading to difficulties in the disaggregation of the toner particles.

In particular, when the toner is degraded, the silica fine particles present as primary particles are buried into the surfaces of the toner particles to reduce the fluidity of the toner. At this time, the silica fine particles present as unburied secondary particles significantly affects the meshing of the particles of the toner to inhibit the disaggregation of the toner. In the toner according to the present invention, since a large amount of the silica fine particles are present as primary particles, the particles of the toner are barely meshed with each other even if the toner is degraded. For this reason, the particles of the toner are disaggregated one by one when the particles of the toner undergo friction in the blade nip. In other words, "Disaggregation of the toner" described in (2-3) above, which is difficult to attain only by control of the covering rate X1, can be improved.

Furthermore, the present inventors have found that when the covering rate X1 and the diffusion index satisfy the ranges specified by Expression 2 at the same time, the speed of degradation of the toner is significantly reduced. This is probably because when the silica fine particles are present as primary particles on the surfaces of the toner particles and particles of the toner contact each other, the probability that the silica fine particles contact each other is reduced and the pressure applied to the silica fine particles is reduced. Namely, the effect described in (1) can be attained.

In the present invention, the boundary of the diffusion index is a function wherein the covering rate X1 is a variable in the range of the covering rate X1 of 40.0 area % or more and 75.0 area % or less. When the covering rate X1 and the diffusion index are determined by varying the silica fine particles and conditions on external addition, the function is empirically obtained from the phenomenon that the toner sufficiently disaggregates during application of pressure.

Figure 5:
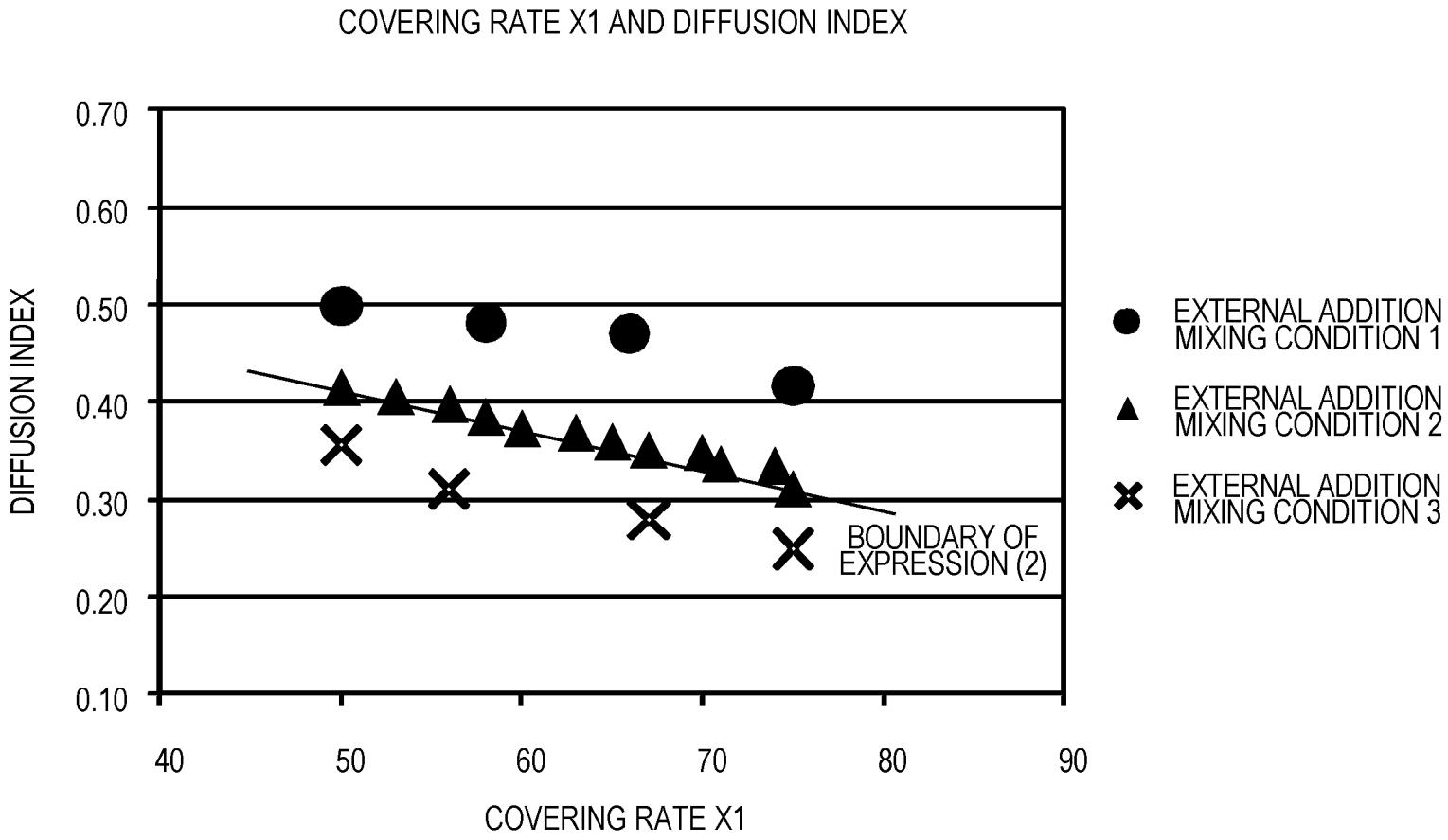
FIG. 5 is a diagram illustrating the boundary of the diffusion index.

FIG. 5 is a graph showing a relationship between the covering rate X1 and the diffusion index when the amount of the silica fine particles to be added is varied on three different conditions on external addition by mixing to arbitrarily vary the covering rate X1, and toners are prepared. It has been found that of the toners plotted in the graph, the disaggregation of the toner is sufficiently enhanced during application of pressure in the toner plotted in the region in which Expression 2 is satisfied.

Although the detailed reason why the boundary of the diffusion index depends on the covering rate X1 is not clarified, the present inventors presume as follows. To enhance the disaggregation of the toner during application of pressure, the amount of the silica fine particles existing as secondary particles may be small. The covering rate X1, however, has no small effect on the disaggregation of the toner. As the covering rate X1 increases, the disaggregation of the toner is gradually increased, and as a result the allowance of the amount of the silica fine particles existing as secondary particles is also increased. Thus, the present inventors think that the boundary of the diffusion index is a function wherein the covering rate X1 is a variable. Namely, the present inventors have empirically determined that the covering rate X1 and the diffusion index have a correlation and it is important to control the diffusion index according to the covering rate X1.

In contrast, when the diffusion index is in the range specified by Expression 3, the amount of the silica fine particles existing as secondary particles is large, leading to insufficient disaggregation of the toner. As a result, fluidity is reduced and fogging is increased.

$$\text{diffusion index} < -0.0042 \times X1 + 0.62 \quad \text{(Expression 3)}$$

As has been described above, to reduce fogging in the present invention, the effects (1) and (2) above should be attained. Among these, the present inventors think that the effects described in (2-1) to (2-3) can be attained for the first time by a synergetic effect in combination with "surface properties of the silica fine particles" and the "state of the silica fine particles externally added."

Next, the toner contains preferably 0.40 parts by mass or more and 1.50 parts by mass or less of the silica fine particles based on 100 parts by mass of the toner particles. The toner contains more preferably 0.60 parts by mass or more and 1.20 parts by mass or less of the silica fine particles based on 100 parts by mass of the toner particles. If the content of the silica fine particles is controlled to fall within the range, the fluidity of the toner can be properly controlled and high quality images can be formed. At a content of the silica fine particles of less than 0.40 parts by mass, the toner has low fluidity and fogging cannot be sufficiently suppressed.

The silica fine particles can be treated with 15.0 parts by mass or more and 40.0 parts by mass or less of silicone oil based on 100 parts by mass of a silica raw material. The fixation rate (%) of the silicone oil can be 70% or more in terms of the amount of carbon. The fixation rate (%) of the silicone oil in terms of the amount of carbon corresponds to the amount of the silicone oil molecules chemically bonded to the surface of the silica raw material.

For the silica fine particles used in the toner according to the present invention, the amount (parts) thereof treated with silicone oil and the fixation rate thereof can be controlled within the ranges to control the aggregation properties between the silica fine particles and the friction coefficient thereof. The same properties can be given to the toner to which the silica fine particles are externally added, and the effect (2) above is attained. Although the detailed mechanism to demonstrate the effect is not clarified, the present inventors presume as follows.

If the amount of silicone oil to be added to the silica raw material is increased, the low surface energy of the silicone oil molecule improves the releasing properties of the toner from the developing roller or the toner layer thickness controlling member. The affinity between the silicone oil molecules reduces the releasing properties or aggregation properties of the silica fine particles and increases the friction coefficient of the silica fine particles. Silica fine particles treated with a relatively large amount of the silicone oil and having a high fixation rate can increase the friction coefficient without reducing the aggregation properties of the silica fine particles. The present inventors think that a reduction in aggregation properties can be reduced by fixing the terminals of the silicone oil molecules to the surface of the silica raw material.

Next, influences of the silica fine particles on the surfaces of the toner particles in external addition to the toner particles will be described. When a covering rate X1 of the surface of each of the toner particles with the silica fine particles is in the range described later and particles of the toner contact each other, microscopically the contact between the silica fine particles existing on the surfaces of the toner particles is dominant, and the toner particles are also strongly influenced by the properties of the silica fine particles. For this reason, the toner according to the present invention has an increased friction coefficient of particles of toner without reducing the aggregation properties thereof and improved releasing properties from the developing roller or the toner layer thickness controlling member.

If the friction coefficient is increased without reducing the aggregation properties of particles of the toner, the toner not contacting the toner layer thickness controlling member or the developing roller can move by a sufficient frictional force produced between the particles of the toner when the toner contacting the toner layer thickness controlling member or the developing roller moves. As a result, the toner can be significantly circulated in the blade nip. Namely, the effects (2-1) and (2-2) can be attained at the same time.

If the amount (parts) of the silicone oil used in the surface treatment is less than 15.0 parts by mass, a sufficient friction coefficient cannot be attained, and the toner is barely circulated in the blade nip. As a result, fluidity may reduce to increase fogging. If the amount (parts) of the silicone oil used in the surface treatment is more than 40.0 parts by mass, a sufficient friction coefficient can be attained while the fixation rate is difficult to control within a proper range and the silica fine particles readily aggregates each other. As a result, fluidity may reduce to increase fogging. If the fixation rate of silicone oil in terms of the amount of carbon is less than 70%, the aggregation properties of the silica fine particles reduce, and a reduction in fogging may be difficult in such a severe evaluation condition as above.

The amount (parts) of the silica fine particles to be treated with silicone oil is more preferably 17.0 parts by mass or more and 30.0 parts by mass or less, still more preferably 20.0 parts by mass or more and 25.0 parts by mass or less based on 100 parts by mass of the silica raw material. The fixation rate (%) of silicone oil in terms of the amount of carbon is more preferably 90% or more, still more preferably 95% or more.

The toner particles according to the present invention contain a colorant. Examples of the colorant that can be used in the present invention include the followings. Examples of cyan colorants include organic pigments or organic dyes such as copper phthalocyanine compounds and derivatives thereof, anthraquinone compounds, and basic dye lake compounds. Examples of magenta colorants include the following organic pigments or organic dyes such as condensation azo compounds, diketopyrrole compounds, anthraquinones, quinacridone compounds, basic dye lake compounds, naphthol compounds, benzimidazolone compounds, thioindigo compounds, and perylene compounds. Examples of yellow colorants include organic pigments or organic dyes of the following compounds such as condensation azo compounds, isoindolinone compounds, anthraquinone compounds, azo metal complexes, methine compounds, and allylamide compounds. Examples of black colorants include carbon black, and black products using the yellow colorants, the magenta colorants, and the cyan colorants. The amount of the colorant to be added can be 1 part by mass or more and 20 parts by mass or less based on 100 parts by mass of the binder resin.

The toner particles according to the present invention contain a binder resin. Any binder resin, such as polyester resin, can be used.

The toner according to the present invention can contain a magnetic substance. In the present invention, the magnetic substance can serve as a colorant. The magnetic substance used in the present invention is composed of triiron tetraoxide or γ-iron oxide as a main component, and may contain elements such as phosphorus, cobalt, nickel, copper, magnesium, manganese, and aluminum. Examples of the shape of the magnetic substance include polyhedrons, octahedrons, hexahedrons, spherical shapes, needle-like shapes, and flakes. Magnetic substances in polyhedral, octahedral, hexahedral, and spherical shapes, which have small anisotropy, can be used to increase image density. In the present invention, the content of the magnetic substance can be 50 parts by mass or more and 150 parts by mass or less based on 100 parts by mass of a binder resin.

The toner according to the present invention can contain a wax. The wax to be contained can be a hydrocarbon wax. Examples of the wax also include amide wax, higher fatty acid, long-chain alcohol, ketone wax, ester wax, and derivatives thereof such as graft compounds and block compounds thereof. Optionally two or more of these waxes may be used in combination. Among these, hydrocarbon wax produced by a Fischer-Tropsch is preferable because developability can be maintained well for a long time and high off-set resistance at high temperatures can also be maintained when the hydrocarbon wax is used. These hydrocarbon waxes may contain an antioxidant in the range so as not to impair the charging properties of the toner. The content of the wax is preferably 4.0 parts by mass or more and 30.0 parts by mass or less, more preferably 16.0 parts by mass or more and 28.0 parts by mass or less based on 100 parts by mass of the binder resin.

The toner according to the present invention may optionally contain a charge-controlling agent. The charge-controlling agent can be compounded to stabilize charging properties and control so as to optimize the frictional charge amount according to the developing system. Known charge-controlling agents can be used. In particular, charge-controlling agents that allow high speed charging and can maintain a predetermined charge amount stably can be used. When the toner particles are prepared by direct polymerization, charge-controlling agents that barely inhibit polymerization and contain substantially no soluble substance in an aqueous medium are preferred. The toner according to the present invention can contain these charge-controlling agents singly or in combinations of two or more. The amount of the charge-controlling agent to be compounded is preferably 0.3 parts by mass or more and 10.0 parts by mass or less, more preferably 0.5 parts by mass or more and 8.0 parts by mass or less based on 100 parts by mass of a binder resin.

The toner according to the present invention contains toner particles and silica fine particles. The silica fine particles used in the present invention can be prepared by hydrophobizing 100 parts by mass of the silica raw material with 15.0 parts by mass or more and 40.0 parts by mass or less of silicone oil. The degree of hydrophobization determined by a methanol titration test is preferably 70% or more, more preferably 80% or more from the viewpoint of suppression of a reduction in charging properties under a high temperature and high humidity environment.

Examples of the silicone oil include dimethyl silicone oil, methylphenyl silicone oil, α-methylstyrene modified silicone oil, chlorophenyl silicone oil, and fluorine modified silicone oil. These may be used singly or in combinations of two or more.

In the present invention, the kinematic viscosity at 25° C. of the silicone oil used in the treatment of the silica fine particles can be 30 cSt or more and 500 cSt or less. At a kinematic viscosity in the range above, the uniformity of the silica raw material can be readily controlled during hydrophobization of the silica raw material with the silicone oil. Furthermore, the kinematic viscosity of the silicone oil has a close relationship with the length of the molecule chain of the silicone oil. At a kinematic viscosity in the range above, the degree of aggregation of the silica fine particles can be readily controlled within a suitable range. A more preferred range of the kinematic viscosity at 25° C. of the silicone oil is cSt or more and 300 cSt or less. Examples of an apparatus for measuring the kinematic viscosity of the silicone oil include a capillary kinematic viscometer (available from Kaburagi Kagaku Kikai Kogyo K.K.) or an automatic micro kinematic viscometer (available from VISCOTECH CO., LTD.).

The silica fine particles used in the present invention can be prepared by treating the silica raw material with silicone oil, and then treating the silica raw material with at least one of alkoxysilane and silazane. Thereby, the surface of the silica raw material which cannot be hydrophobized with silicone oil can be hydrophobized to stably attain silica fine particles highly hydrophobized. Furthermore, the disaggregation of the toner can be significantly enhanced. Although the detailed reason why the disaggregation of the toner can be enhanced is not clarified, the present inventors think as follows. Among terminals of the silicone oil molecules on the surfaces of the silica fine particles, only one terminal has freedom and affects the aggregation properties of the silica fine particles. By the 2-stage treatment described above, the terminals of the silicone oil molecules are hard to exist on the outermost surfaces of the silica fine particles, and therefore the aggregation of the silica fine particles can be suppressed more significantly. That is, by employing the 2-stage treatment, the aggregation of the toner particles can be significantly reduced at the time when the silica fine particles are externally added, and disaggregation of the toner is enhanced.

In the present invention, the silica raw material that can be used are dry silica so-called dry or fumed silica prepared by vapor-phase oxidation of silicon halide and the so-called wet silica prepared from liquid glass, for example. These may be used alone or in combination.

The silica fine particles used in the present invention may be crushed during or after the treatment step with silicone oil. When the 2-stage treatment is performed, crushing can be performed between the two treatment steps.

The surface treatment of the silica raw material with silicone oil and the surface treatment thereof with alkoxysilane and silazane may be a dry method or a wet method.

A procedure of the surface treatment of the silica raw material with silicone oil will be specifically described. For example, silica fine particles are added to a solvent having silicone oil dissolved therein to make reaction, and subsequently, the solvent is removed. The solvent can be adjusted at a pH of 4 with an organic acid or the like. Subsequently, the crushing may be performed. An alternative method may be used. Silica fine particles are placed in a reaction tank. Under a nitrogen atmosphere, an alcohol is added while being stirred. Silicone oil is introduced into the reaction tank to perform surface treatment. The solvent is removed by stirring under heating. Then, the product is crushed.

A procedure of the surface treatment with at least one of alkoxysilane and silazane will be specifically described. The crushed silica fine particles treated with silicone oil are added to a solvent having at least one of alkoxysilane and silazane dissolved therein to make reaction. Subsequently, the solvent is removed. Subsequently, the product may be crushed. At least one of alkoxysilane and silazane is introduced under a nitrogen atmosphere while being stirred, and is subjected to surface treatment. The solvent is removed by stirring under heating. Then, the product can be cooled.

Suitable examples of the alkoxysilane include methyltrimethoxysilane, dimethyldimethoxysilane, phenyltrimethoxysilane, methyltriethoxysilane, dimethyldiethoxysilane, and phenyltriethoxysilane. Suitable examples of the silazane include hexamethyldisilazane. The total amount of at least one of alkoxysilane and silazane used in the surface treatment can be 0.1 parts by mass or more and 20.0 parts by mass or less based on 100 parts by mass of the silica raw material.

To increase the fixation rate of the silica fine particles with silicone oil in terms of the amount of carbon, silicone oil needs to be chemically fixed onto the surface of the silica raw material during preparation of the silica fine particles. For this purpose, a heat treatment can be performed during preparation of the silica fine particles to react silicone oil. The heating temperature can be 100° C. or more. A higher heating temperature can attain a higher fixation rate. The heating step can be performed immediately after the surface treatment with silicone oil is performed. When the crushing is performed, the heating step may be performed after the crushing step.

The silica fine particles used in the present invention can have an apparent density of 15 g/L or more and 50 g/L or less. If an apparent density of the silica fine particles within this range, the silica fine particles are present not so densely, contain a large amount of air between the silica fine particles, and have a low apparent density. Because of these properties, particles of the toner can be prevented from being so dense to significantly reduce the speed of a reduction in degradation of the toner. A more preferred range of the apparent density is 18 g/L or more and 45 g/L or less.

Examples of a method of controlling the apparent density of the silica fine particles to fall within the range above include adjustment of the particle diameter of the silica raw material used for the silica fine particles, the crushing step to be performed or not and the strength of the crushing, and the amount of silicone oil used in the surface treatment. A reduction in the particle diameter of the silica raw material can increase the BET specific surface area of the silica fine particles to be prepared. As a result, the silica fine particles can contain a large amount of air therebetween to reduce the apparent density. The crushing step can be performed to disaggregate relatively large secondary particles contained in the silica fine particles into relatively small secondary particles to reduce the apparent density.

To give high fluidity to the toner, the silica raw material used in the present invention can have a specific surface area (BET specific surface area) of 130 $m^2/g$ or more and 330 $m^2/g$ or less, which is determined by nitrogen adsorption according to a BET method. A BET specific surface area within this range can readily ensure the fluidity and charging properties to be given to the toner. The BET specific surface area of the silica raw material is more preferably 200 $m^2/g$ or more and 320 $m^2/g$ or less. The BET specific surface area is measured according to JIS Z 8830 (2001). For the measurement apparatus, an "automatic specific surface area and pore distribution measurement apparatus TriStar 3000 (available from SHIMADZU Corporation)" is used. The TriStar 3000 employs a gas adsorption method according to a constant volume method as a measurement method.

The primary particles of the silica raw material used in the present invention have a number average particle diameter of preferably 3 nm or more and 50 nm or less, more preferably 5 nm or more and 40 nm or less. The weight average particle diameter (D4) of the toner particles is preferably 5.0 μm or more and 10.0 μm or less, more preferably 5.5 μm or more and 9.5 μm or less from the viewpoint of the balance between developability and fixing properties.

The toner particles have an average circularity of preferably 0.960 or more, more preferably 0.970 or more. If the toner particles have an average circularity of 0.960 or more, the toner has a spherical shape or a substantially spherical shape, and readily attains high fluidity and uniform friction charging properties. For this reason, preferably the toner can readily maintain high developability even in the latter half of the durability test. In addition, preferably toner particles having a high average circularity can be readily controlled to have the covering rate X1 and the diffusion index within the ranges specified in the present invention during external addition of inorganic fine particles described later. Furthermore, such toner particles having a high average circularity are preferred from the viewpoint of disaggregation of the toner during application of pressure because the meshing of the toner particles due to the shapes of the surfaces thereof barely occurs and the disaggregation of the toner can be enhanced more significantly.

Examples of a method of preparing the toner according to the present invention will be described below, but the method will not be limited to these. The method of preparing the toner according to the present invention may include any step as long as the amount of the silica fine particles treated with silicone oil, the fixation rate of silicone oil in terms of the amount of carbon, the covering rate X1, the diffusion index, and preferably the average circularity can be adjusted.

In preparation of the toner by a grinding method, for example, a binder resin and a colorant, and optionally other additives such as a mold release agent are sufficiently mixed with a mixer such as a Henschel mixer or a ball mill. Subsequently, the toner materials are melt kneaded with a heat kneader such as a heat roll, a kneader, and an extruder to disperse or dissolve the toner materials. The kneaded product is solidified by cooling, is ground, is classified, and is surface treated to prepare toner particles. The classification may be performed before or after the surface treatment. In the classification step, a multi classifier can be used for production efficiency.

The grinding can be performed by a method with a known grinder of a mechanical impact type or a jet type. To attain a toner having a preferred circularity specified in the present invention, additional treatment to grind the kneaded product under heating or apply a mechanical impact supplementally can be performed. Alternatively, a hot water bath method of dispersing pulverized (optionally classified) toner particles in hot water or a method of passing toner particles through hot air stream may be used.

Examples of a method of applying a mechanical impact include methods with a mechanical impact mill such as a CRYPTRON system available from Kawasaki Heavy Industries, Ltd. and a turbo mill available from FREUND-TURBO CORPORATION. Examples thereof also include methods of applying a mechanical impact such as a compressive force and a frictional force to a toner with an apparatus such as a Mechanofusion system available from Hosokawa Micron Corporation and a hybridization system available from Nara Machinery Co., Ltd.

The toner particles used in the present invention are prepared in an aqueous medium preferably by a method such as dispersion polymerization, association aggregation, dissolution suspension, and suspension polymerization, and more preferably by suspension polymerization.

In the suspension polymerization, a polymerizable monomer, a colorant, and optionally other additives such as a polymerization initiator, a crosslinking agent, and a charge-controlling agent are uniformly dissolved or dispersed to prepare a polymerizable monomer composition. Subsequently, the polymerizable monomer composition is dispersed in a continuous phase (such as an aqueous phase) containing a dispersion stabilizer with a proper stirrer, and is the polymerizable monomer in the polymerizable monomer composition is polymerized to prepare toner particles having a desired particle diameter. The toner particles prepared by the suspension polymerization (hereinafter also referred to as "polymerization toner particles") can have a substantially spherical shape. Such toner particles can have a predetermined average circularity and relatively uniform distribution of the charge amount.

In preparation of the polymerized toner particles, any known polymerizable monomer for the polymerizable monomer composition can be used. Among these, styrene or a styrene derivative can be used alone or by mixing with another polymerizable monomer from the viewpoint of the developing properties and the durability of the toner.

In the present invention, the polymerization initiator used in the suspension polymerization can have a half-life period during the polymerization reaction of 0.5 hours or more and 30.0 hours or less. The amount of the polymerization initiator to be added can be 0.5 parts by mass or more and 20.0 parts by mass or less based on 100 parts by mass of the polymerizable monomer. Specific examples of the polymerization initiator include azo or diazo polymerization initiators and peroxide polymerization initiators. These may be used alone or in combination.

In the suspension polymerization, a crosslinking agent may be added during the polymerization reaction. The amount of the crosslinking agent to be added is 0.1 parts by mass or more and 10.0 parts by mass or less based on 100 parts by mass of the polymerizable monomer. A polymerizable compound having two or more double bonds is used as the crosslinking agent. Examples thereof include aromatic divinyl compounds, carboxylic acid esters having two double bonds, divinyl compounds, and compounds having 3 or more vinyl groups. These are used singly or as a mixture of two or more.

Specific preparation of toner particles by the suspension polymerization will now be described, but the preparation will not be limited to this. First, the polymerizable monomer, the colorant, and the like are properly added, and are uniformly dissolved or dispersed with a dispersing machine such as a homogenizer, a ball mill, and an ultrasonic dispersing machine to prepare a polymerizable monomer composition. The polymerizable monomer composition is suspended in an aqueous medium containing a dispersion stabilizer. At this time, the polymerizable monomer composition is formed into toner particles having a desired particle diameter with a dispersing machine such as a high-speed stirrer or an ultrasonic dispersing machine at once. Thereby, the toner particles to be prepared have shaper distribution of the particle diameter. The polymerization initiator may be added simultaneously when other additives are added to the polymerizable monomer or immediately before the polymerizable monomer composition is suspended in an aqueous medium. Alternatively, a polymerization initiator dissolved in the polymerizable monomer or a solvent may be added immediately after granulation and before the polymerization reaction is initiated. After the granulation, the particles may be stirred with a stirrer to such an extent that the states of the particles are maintained and floating and sediment thereof are prevented.

Any known surfactant, organic dispersant, or inorganic dispersant can be used as the dispersion stabilizer. Among these, inorganic dispersants can be used for the following reasons: these barely generate harmful ultra fine powder; dispersion stability is attributed to their steric hindrance and is barely affected even if the reaction temperature is varied; and inorganic dispersants are readily washed off and barely affect the toner. Examples of the inorganic dispersants include phosphoric acid polyvalent metal salts such as calcium phosphate, magnesium phosphate, aluminum phosphate, zinc phosphate, and hydroxy apatite; carbonates such as calcium carbonate and magnesium carbonate; inorganic salts such as calcium metasilicate, calcium sulfate, and barium sulfate; and inorganic compounds such as calcium hydroxide, magnesium hydroxide, and aluminum hydroxide. Preferably, 0.20 parts by mass or more and 20.00 parts by mass or less of the inorganic dispersant is used based on 100 parts by mass of the polymerizable monomer. These dispersion stabilizers may be used singly or in combinations of two or more. Furthermore, 0.0001 parts by mass or more and 0.1000 parts by mass or less of a surfactant may be used in combination based on 100 parts by mass of the polymerizable monomer.

In the polymerization reaction of the polymerizable monomer, the polymerization temperature is set preferably at 40° C. or more, more preferably at 50° C. or more and 90° C. or less.

After the polymerization of the polymerizable monomer is completed, the resulting polymer particles are filtered, are washed, and are dried to prepare toner particles. The silica fine particles as an inorganic fine particle are externally added to the toner particles by mixing to adhere to the surfaces of the toner particles. The toner according to the present invention is prepared. A classification step can be performed before mixing of the inorganic fine particle to remove coarse particles and fine particles in the toner particles.

The toner according to the present invention may contain, in addition to the silica fine particles, particles containing primary particles having a number average particle diameter (D1) of 80 nm or more and 3 μm or less. Examples of the particle include lubricants such as fluorine resin powder, zinc stearate powder, and polyvinylidene fluoride powder; polishing agents such as cerium oxide powder, silicon carbide powder, and strontium titanate powder; and spacer particles such as silica. These particles can be slightly added so as not to impair the effect of the present invention.

Any known mixing apparatus can be used as a mixing apparatus for externally adding the silica fine particles by mixing. An apparatus illustrated in FIG. 6 can be used because the covering rate X1 and the diffusion index can be readily controlled.

Figure 6:
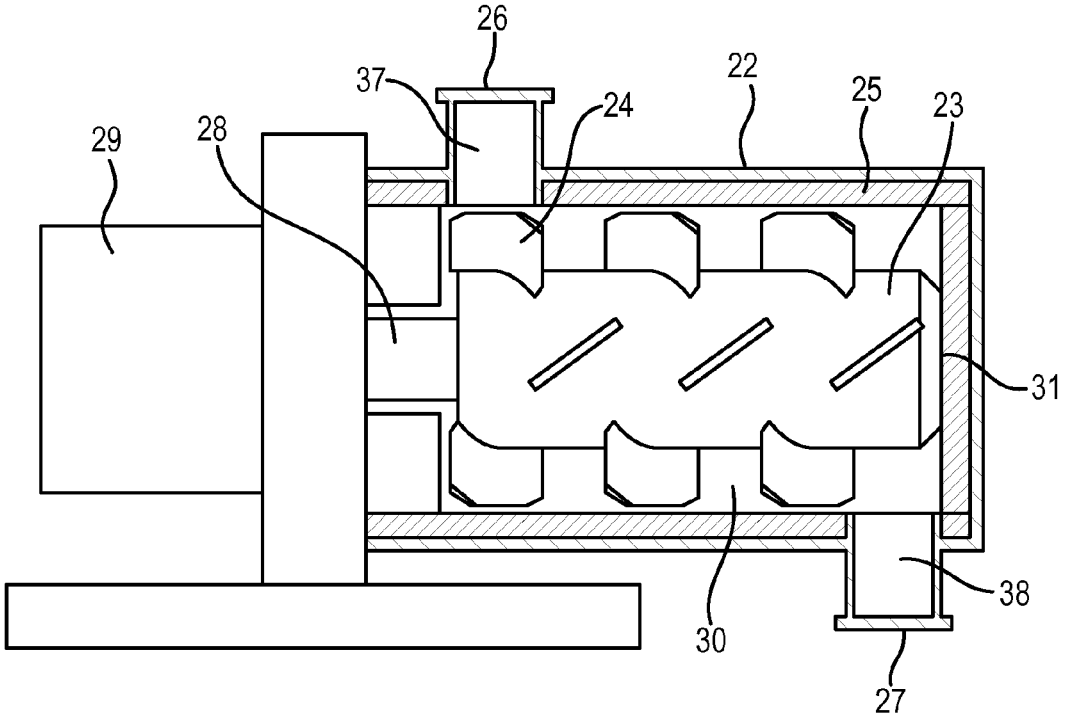
FIG. 6 is a cross sectional view illustrating an example of a mixing apparatus which can be used for external addition of inorganic fine particles by mixing.
Figure 7:
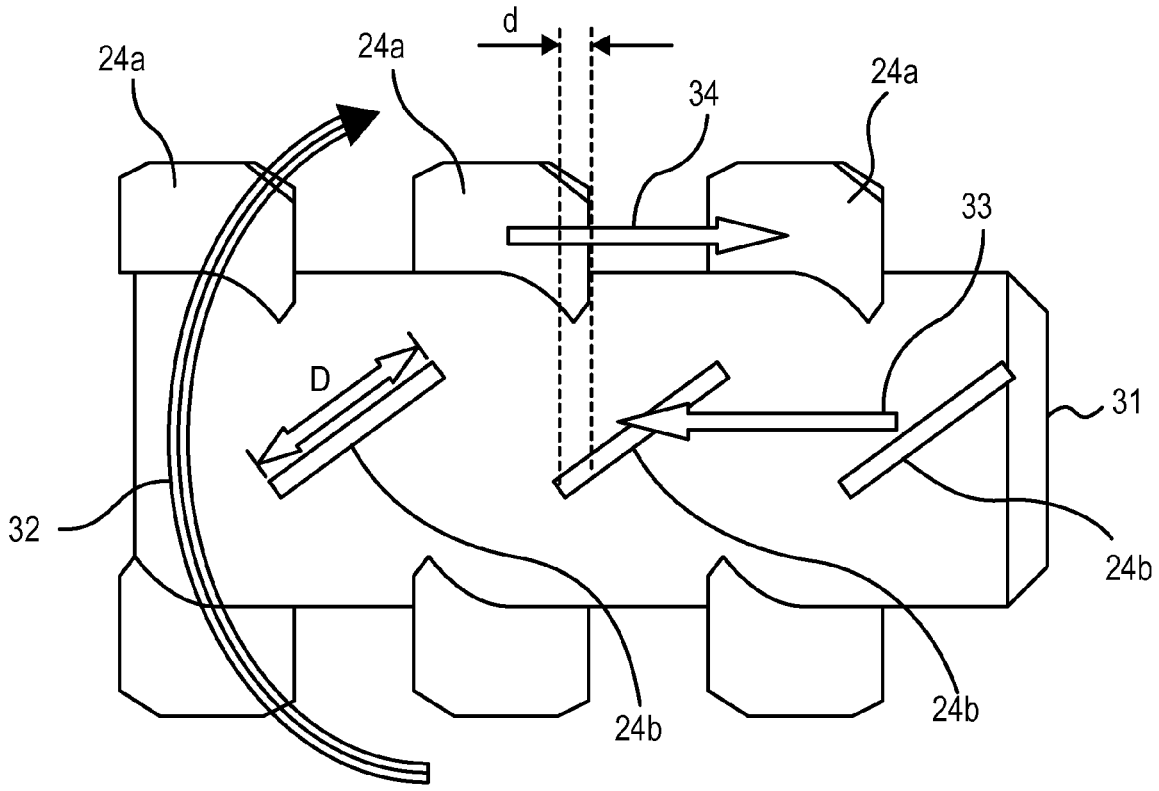
FIG. 7 is a side view illustrating an example of a configuration of a stirring member used in the mixing apparatus.

FIG. 6 is a schematic view illustrating an example of a mixing apparatus that can be used in external addition of the silica fine particles used in the present invention by mixing. FIG. 7 is a schematic view illustrating an example of a configuration of a stirring member used in the mixing apparatus. The mixing apparatus is configured to apply a shear force to the toner particles and the silica fine particles in a narrow clearance, so that the silica fine particles can be applied to the surfaces of the toner particles while secondary particles thereof are being disaggregated into primary particles thereof. Furthermore, as described later, the toner particles and the silica fine particles are readily circulated in the axial direction of a rotary member, and are sufficiently uniformly mixed before these particles solidify. For this reason, the covering rate X1 and the diffusion index are readily controlled to fall within the preferred ranges specified in the present invention.

A step of externally adding the silica fine particles by mixing will now be described with reference to FIG. 6 and FIG. 7. The mixing apparatus for externally adding the silica fine particles by mixing includes at least a rotary member 23 provided with a plurality of stirring members 24 on the surface thereof, a driving unit 29 rotatably driving the rotary member 23, and a main body casing 22 spaced from the stirring members 24. It is important to constantly and finely maintain spaces (clearances) formed between the inner circumferential portion of the main body casing 22 and the stirring members 24 to uniformly give a shear force to the toner particles and apply the silica fine particles to the surfaces of the toner particles while secondary particles of the silica fine particles are being disaggregated into primary particles thereof.

In the apparatus, the diameter of the inner circumferential portion of the main body casing 22 can be twice or less the diameter of the outer circumferential portion of the rotary member 23. In FIG. 6, an example is illustrated in which the diameter of the inner circumferential portion of the main body casing 22 is 1.7 times the diameter of the outer circumferential portion of the rotary member 23 (diameter of the body of the rotary member 23 excluding the stirring members 24). If the diameter of the inner circumferential portion of the main body casing 22 is twice or less the diameter of the outer circumferential portion of the rotary member 23, the space for treatment in which a force acts on the toner particles is properly limited. As a result, a sufficient impact is applied to the secondary particles of the silica fine particles.

It is important to adjust the clearances according to the size of the main body casing 22. For the viewpoint of application of a sufficient shear force to the silica fine particles, the clearances each can occupy about 1% or more and 5% or less of the diameter of the inner circumferential portion of the main body casing 22. Specifically, when the diameter of the inner circumferential portion of the main body casing 22 is about 130 mm, the clearances can have lengths of 2 mm or more and 5 mm or less. When the diameter of the inner circumferential portion of the main body casing 22 is 800 mm, the clearances can have lengths of 10 mm or more and 30 mm or less.

In the step of externally adding the silica fine particles by mixing, a mixing apparatus is used to rotate the rotary member 23 by the driving unit 29, and the toner particles and the silica fine particles placed in the mixing apparatus are mixed by stirring to externally adding the silica fine particles to the surfaces of the toner particles by mixing.

As illustrated in FIG. 7, at least part of a plurality of stirring members 24 functions as stirring members 24*a* for feeding. Accompanied by the rotation of the rotary member 23, the stirring members 24*a* feed the toner particles and the silica fine particles in one direction of the axial direction of the rotary member. At least part of a plurality of stirring members 24 functions as stirring members 24*b* for reversing. Accompanied by the rotation of the rotary member 23, the toner particles and the silica fine particles are reversed in the other direction of the axial direction of the rotary member. Here, as illustrated in FIG. 6, when a raw material inlet 26 and a product outlet 27 are provided in the respective ends of the main body casing 22, the direction from the raw material inlet 26 to the product outlet 27 (to the right in FIG. 6) is called the "feeding direction".

Namely, as illustrated in FIG. 7, the stirring members 24*a* for feeding have the surfaces inclined so as to feed the toner particles in the feeding direction 34. The stirring members 24*b* have the surfaces inclined so as to feed the toner particles and the silica fine particles in the reverse direction 33. Thereby, the silica fine particles are externally added to the surfaces of the toner particles by mixing while the particles are repeatedly being fed from the feeding direction 34 to the reverse direction 33.

The stirring members 24*a* and 24*b* form a set of members disposed at intervals in the circumferential direction of the rotary member 23. In the example illustrated in FIG. 7, one stirring member 24*a* and one stirring member 24*b* disposed at an interval of 180° in the rotary member 23 form a set. Three stirring members disposed at intervals of 120°, or four stirring members disposed at intervals of 90° may form a set, for example. In the example illustrated in FIG. 7, a total of twelve stirring members 24*a* and 24*b* are formed at equal intervals.

In FIG. 7, D represents the width of the stirring member, and d represents an interval indicating the overlapped portion of the stirring members. To efficiently feed the toner particles and the silica fine particles in the feeding direction 34 and the reverse direction 33, the width D can be 20% or more and 30% or less of the length of the rotary member 31 in FIG. 7. In the example illustrated in FIG. 7, the width D is 23% of the length of the rotary member 31. Furthermore, the stirring members 24*a* and 24*b* can have overlapped portion d of the stirring members 24*b* and the stirring members when an extending line is drawn from the end of the stirring members 24*a* in the vertical direction. This overlapped portion can efficiently apply a shear force to the secondary particles of the silica fine particles. The proportion of d to D can be 10% or more and 30% or less from the viewpoint of application of a shear force. The blade can have any shape other than the shape illustrated in FIG. 7 as long as the toner particles can be fed in the feeding direction and the reverse direction and the clearances can be maintained. For example, the blade may have a curved surface or a paddle structure connected to the rotary member with a rod-like arm provided at one end of the blade.

With reference to the schematic views of the apparatus illustrated in FIG. 6 and FIG. 7, the present invention will now be described in more detail. The apparatus illustrated in FIG. 6 includes at least a rotary member 23 provided with a plurality of stirring members 24 on the surface thereof, a driving unit 29 rotatably driving the rotary member 23, a main body casing 22 spaced from the stirring members 24, and a jacket 25 disposed inside the main body casing 22 on the end surface of the rotary member 31, a cooling and heating medium flowing through the jacket. Furthermore, the apparatus illustrated in FIG. 6 includes a raw material inlet 26 disposed on an upper portion of the main body casing 22 to introduce the toner particles and the silica fine particles. The apparatus illustrated in FIG. 6 also includes a product outlet 27 disposed on a lower portion of the main body casing 22 to discharge the toner externally added by mixing from the main body casing 22 to the outside. The apparatus illustrated in FIG. 6 further includes an inner piece 37 for the raw material inlet disposed inside the raw material inlet 26 and an inner piece 38 for the product outlet disposed inside the product outlet 37.

In the present invention, first, the inner piece 37 for the raw material inlet is extracted from the raw material inlet 26, and the toner particles are placed in a treatment space 30 from the raw material inlet 26. Next, the silica fine particles are placed in the treatment space 30 from the raw material inlet 26, and the inner piece 37 for the raw material inlet is inserted. Next, the rotary member 23 is rotated by the driving unit 29 (in the rotational direction 32), and the external addition by mixing are performed while the particles to be treated are being mixed by stirring with the stirring members 24 disposed on the surface of the rotary member 23. These materials may be added in any order. The silica fine particles may be added from the raw material inlet 26, and then the toner particles may be added from the raw material inlet 26. Alternatively, the toner particles and the silica fine particles may be preliminarily mixed with a mixer such as a Henschel mixer, and the mixture may be added from the raw material inlet 26 of the apparatus illustrated in FIG. 6.

For the conditions on external addition by mixing, the power of the driving unit 29 can be controlled to be 0.2 W/g or more and 2.0 W/g or less to attain the covering rate X1 and the diffusion index specified in the present invention. The power of the driving unit 29 is controlled to be more preferably 0.6 W/g or more and 1.6 W/g or less. At a power of 0.2 W/g or more, the covering rate X1 is increased to readily control the diffusion index within the range specified by the present invention. At a power of 2.0 W/g or less, the silica fine particles can be prevented from being excessively buried. Any treatment time can be used. The treatment time can be 3 minutes or more and 10 minutes or less. At a treatment time of 3 minutes or more, the covering rate X1 and the diffusion index are readily controlled within the ranges specified by the present invention.

The external addition by mixing can be performed at any number of rotations of the stirring members without particular limitation. However, the number of rotations of the stirring member can be 800 rpm or more and 3000 rpm or less where the volume of the treatment space 30 in the apparatus illustrated in FIG. 6 is $2.0\times10^{-3}$ $m^3$ and the stirring member 24 has the shape in FIG. 7. If the number of rotations of the stirring member is 800 rpm or more and 3000 rpm or less, the covering rate X1 and the diffusion index in the ranges specified by the present invention are readily attained.

Furthermore, in the present invention, the pre-mixing step can be performed before the external addition operation by mixing. The pre-mixing step highly uniformly disperses the silica fine particles on the surfaces of the toner particles to readily attain a high covering rate X1 and a high diffusion index. More specifically, a pre-mixing condition can be set at a power of the driving unit 29 of 0.06 W/g or more and 0.20 W/g or less and a treatment time of 0.5 minutes or more and 1.5 minutes or less. If the power is 0.06 W/g or more or the treatment time is 0.5 minutes or more, the particles are sufficiently uniformly mixed. If the power is 0.20 W/g or less or the treatment time is 1.5 minutes or less, the silica fine particles can be prevented from solidifying on the surface of the toner particles before the particles are sufficiently uniformly mixed.

The pre-mixing can be performed at any number of rotations of the stirring member. However, the number of rotations of the stirring members can be 50 rpm or more and 500 rpm or less when the stirring members 24 have the shapes illustrated in FIG. 7 in an apparatus illustrated in FIG. 6 having a treatment space 30 having a volume of $2.0\times10^{-3}$ $m^3$. If the number of rotations of the stirring member is 50 rpm or more and 500 rpm or less, the covering rate X1 and the diffusion index in the ranges specified by the present invention are readily attained.

After the external addition by mixing is completed, the inner piece 38 for a product outlet in the product outlet 27 is extracted, and the rotary member 23 is rotated by the driving unit 29 to discharge a toner from the product outlet 27. The toner is optionally separated from coarse particles with a sieving machine such as a circular vibration sieving machine. The target toner is prepared.

<<Method of Measuring Physical Properties>>

The methods of measuring a variety of physical properties according to the present invention will now be described.

[1] Measurement of Volume Resistivity of Coverage Portion

<Equipment to be Used>

The measurement is performed with a Frequency Response Analyzer 1260 (available from Solartron Analytical) and a Dielectric Interface 1296 (available from Solartron Analytical) (see http://www.toyo.co.jp/solartron/yuudentai.html).

<Sample for Measurement>

A circumferential electrode is formed over 30 mm in width of a developing roller. The electrode is formed by gold evaporation.

<Measurement Conditions>

AC voltage is applied between the electrode disposed on the outer periphery of the developing roller and the substrate thereof to measure the impedance. An AC voltage of 0.1 Vpp is applied, and the frequency is set at 0.01 Hz to 1 MHz.

<Analysis Method>

Figure 8:
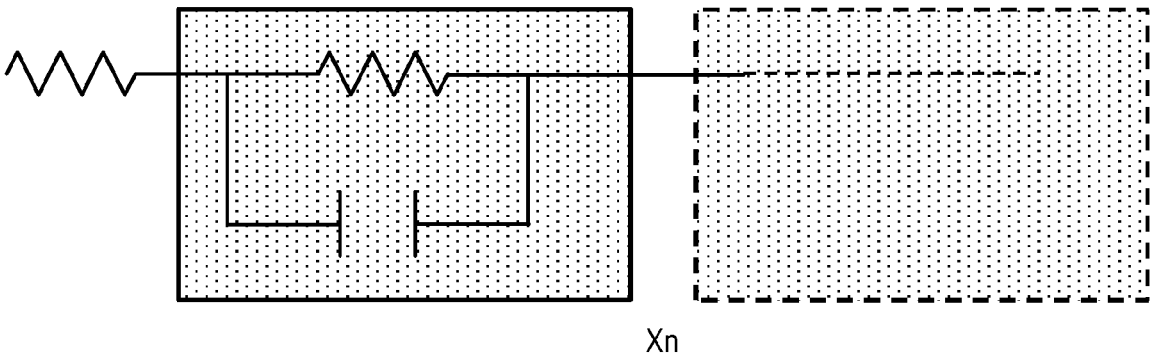
FIG. 8 is a model diagram illustrating a fitting circuit used in impedance analysis.

The data is analyzed with impedance analysis software ZView (ZPlot and ZView for Windows from Scribner Associates). The fitting circuit used in the analysis is set as illustrated in the model diagram in FIG. 8 in which n layers of a "resistance in a measurement system" and a "component in a layer" are connected in series.

[2] Measurement of Average Thickness of Coverage Portion and Average Thickness of Intermediate Layer The average thickness of the coverage portion is determined by observation with a microscope VHX-600 (trade name, available from Keyence Corporation). In the measurement method, 10 arc-like cut samples of a developing roller are prepared at random, and the cross sections thereof are observed at a magnification of 2000 times. In the 10 images observed, the thickness of the coverage portion is measured at the center and both ends of each sample. The average of the 30 thicknesses in total is defined as the average thickness of the coverage portion of the developing roller. When a coverage portion is not found in the observed image, samples to be observed are added until the number of the observed coverage portions reaches 10 places in total. When the coverage portion is only partially disposed, the measured thickness of a place in which no coverage portion exists is 0 μm. The average thickness of the intermediate layer is measured in the same manner.

[3] Measurement of Covering Rate of Coverage Portion

The covering rate of the coverage portion is determined by observation with a laser microscope VK-X100 (trade name, available from Keyence Corporation). In the measurement method, 10 viewing fields on the surface of the developing roller are observed at random with an object lens of 20 times. Each of the viewing fields is divided into 25 grids. Of the 250 grids in total, the grid coated more than half and the number thereof are checked. The covering rate is calculated from the number of the grids coated more than half.

[4] Measurement of Volume Average Particle Diameter of Roughening Particle

The volume average particle diameter of the roughening particle used to form a surface shape of the developing roller is measured with a laser diffraction particle size analyzer Coulter LS-230 (trade name, available from Beckman Coulter, Inc.). In a specific method for measurement, a small module is used, and isopropyl alcohol (IPA) is used as a solvent for measurement. First, the inside of the measurement system in the particle size analyzer is washed with IPA for 5 minutes. After the washing, background function is executed. Next, 1 mg or more and 25 mg or less of a sample for measurement is added to IPA (50 ml) to prepare a suspension. The suspension is dispersed with an ultrasonic dispersing machine for 3 minutes to prepare a sample solution to be tested. The sample solution is gradually added to the measurement system in the analyzer. The concentration of the sample inside the measurement system is adjusted such that the polarization intensity differential scattering (PIDS) on the screen of the apparatus is 45% or more and 55% or less, and the sample is measured. From volume distribution, the volume average particle diameter is determined by calculation.

[5] Measurement of Surface Roughness of Surface of Developing Roller (Ra: Arithmetic Average Roughness)

In a developing carrying member, nine places in total (three places in the axial direction by three places in the circumferential direction) are measured with a surface roughness measuring apparatus SURFCORDER SE-3500 (trade name, available from Kosaka Laboratory Ltd.) according to surface roughness (JIS B 0601-2001). The average value is defined as the surface roughness Ra of the sample (the developing carrying member). The cut off is 0.8 mm, a distance for measurement is 8.0 mm, and the feeding rate is 0.2 mm/sec.

[6] Method of Quantifying Silica Fine Particles (1) Quantification of Content of Silica Fine Particles in Toner (Method of Standard Addition)

A toner (3 g) is placed in an aluminum ring having a diameter of 30 mm, and a pressure of 10 tons is applied to the toner to prepare a pellet. The intensity of silicon (Si) (Si Intensity-1) is determined by a wavelength dispersing fluorescence X-ray analysis (XRF). The conditions on the measurement may be optimized with an XRF apparatus to be used, and a series of measurement of intensity is performed on the same conditions. Silica fine particles (1.0% by mass relative to the toner) having primary particles having a number average particle diameter of 12 nm are added to the toner, and are mixed with a coffee mill. After the mixing, the product is formed into a pellet, and the intensity of Si (Si Intensity-2) is determined in the same manner as above. The same operation is performed on samples having different contents of the silica fine particles (2.0% by mass and 3.0% by mass relative to the toner), and the intensities of Si (Si Intensity-3 and Si Intensity-4) are determined. From Si Intensity-1 to Si Intensity-4, the content of silica in the toner (% by mass) is calculated according to the method of standard addition.

(2) Separation of Silica Fine Particles from Toner

When a toner contains a magnetic substance, the silica fine particles are quantified through the following step. A toner (5 g) is weighed with a precision balance, and is placed in a 200 ml plastic cup with a lid. Methanol (100 ml) is added, and the toner is dispersed with an ultrasonic dispersing machine for 5 minutes. The toner is attracted to a neodymium magnet, and the supernatant solution is discharged. This operation of dispersion in methanol and discharge of the supernatant is repeated three times. Then, 10% by mass NaOH (100 ml) and several drops of "CONTAMINON N" (10% by mass aqueous solution of a neutral detergent for washing a precision measurement apparatus (pH: 7) composed of a nonionic surfactant, an anionic surfactant, and an organic builder, available from Wako Pure Chemical Industries, Ltd.) are added, and are slightly mixed. The mixture is left as it is for 24 hours. Subsequently, particles are separated again with a neodymium magnet. At this time, the recovered particles are repeatedly washed with distilled water to wash off NaOH residues. The recovered particles are sufficiently dried in a vacuum dryer to prepare Particle A. Through the operation, the externally added silica fine particles are dissolved and removed.

(3) Measurement of Intensity of Si in Particle A

Particle A (3 g) is placed in an aluminum ring having a diameter of 30 mm, and a pressure of 10 tons is applied to the toner to prepare a pellet. The intensity of Si (Si Intensity-5) is determined by a wavelength dispersing fluorescence X-ray analysis (XRF). From Si Intensity-5 and Si Intensity-1 to Si Intensity-4 used in the quantification of the content of silica fine particles in the toner, the content of silica in Particle A (% by mass) is calculated.

(4) Separation of Magnetic Substance from Toner

Tetrahydrofuran (100 ml) is added to Particle A (5 g), and is mixed sufficiently. Particle A is ultrasonic dispersed for 10 minutes. Magnetic particles are attracted to a magnet, and the supernatant solution is discharged. This operation is repeated 5 times to prepare Particle B. Through this operation, besides the magnetic substance, almost all of organic components such as a resin can be removed. Some resin not dissolved in tetrahydrofuran may remain. Accordingly, Particle B prepared through the operation above is heated to 800° C. to burn organic components, if remain. Particle C prepared after the heating can be considered approximately as the magnetic substance contained in the toner. The mass of Particle C is measured. The mass can be defined as the content W of the magnetic substance in the magnetic toner (% by mass). At this time, to correct an amount increased by oxidation of the magnetic substance, the mass of Particle C is multiplied by 0.9666 ($Fe_2O_3$--->$Fe_3O_4$). The values obtained from the quantifications above are substituted for variables in the following expression to calculate the amount of the externally added silica fine particles: amount of the externally added silica fine particles (% by mass)=the content of silica in the toner (% by mass)−the content of silica in Particle A (% by mass)

[7] Method of Measuring Covering Rate X1

The covering rate X1 of the surface of the toner particle with the silica fine particles is calculated as follows. The surfaces of the toner particles are subjected to element analysis with the following apparatus on the following conditions:

Measurement apparatus: Quantum 2000 (trade name, available from ULVAC-PHI, Inc.)

X-ray source: monochrome Al Kα

X-ray Setting: 100 μmϕ (25 W (15 KV))

Photoelectron take off angle: 45°

Neutralization condition: neutralization gun in combination with an ion gun

Analysis region: 300×200 μm

Pass Energy: 58.70 eV

Step size: 1.25 eV

Software for analysis: Maltipak (Physical Electronics, Inc.)

Here, the quantified value of an Si atom is calculated with peaks of C 1c (B.E. 280 to 295 eV), O 1s (B.E. 525 to 540 eV), and Si 2p (B.E. 95 to 113 eV). The quantified value of the Si element obtained here is defined as Y1. Next, a single substance of silica fine particles is measured. For a method of obtaining a single substance of silica fine particles from a toner, the method described in "Separation of silica fine particles from toner" is used. The silica fine particles obtained as a single substance of silica fine particles are subjected to element analysis in the same manner as in the element analysis of the surface of the toner. The obtained quantified value of the Si element is defined as Y2. In the present invention, the covering rate X1 of the surface of the toner particle with the silica fine particles is defined as follows:

$$\text{covering rate } X1 \text{ (area \%)} = Y1/Y2 \times 100$$

To enhance the precision of the measurement, Y1 and Y2 is measured twice or more.

[8] Method of Measuring Mass Average Particle Diameter of Toner (D4)

The mass average particle diameter (D4) of the toner (and that of the toner particles) is calculated as follows. For the measurement apparatus, a precision particle size distribution analyzer "Coulter Counter Multisizer 3" (trade name, available from Beckman Coulter, Inc.) is used. The analyzer includes an aperture tube of 100 μm and employs a pore electrical resistance method. The conditions on measurement are set and the data measured is analyzed with the attached dedicated software "Beckman Coulter Multisizer 3 Version 3.51" (trade name, available from Beckman Coulter, Inc.). The measurement is performed with 25000 effective measuring channels.

The electrolytic aqueous solution that can be used in the measurement is a dissolution solution of about 1% by mass super grade sodium chloride in ion exchange water such as "ISOTON II" (trade name, available from Beckman Coulter, Inc.).

The dedicated software is set before the measurement and analysis are performed. With the dedicated software, the total number of counts in the control mode is set at 50000 particles on the "Change standard measuring method (SOM)" screen. The number of measurement is set at 1, and the Kd value is set at a value obtained with "Standard particle 10.0 μm" (available from Beckman Coulter, Inc.). The "button for measurement of threshold/noise level" is pressed to automatically set the threshold and the noise level. The current is at 1600 μA, the gain is set at 2, and the electrolyte solution is set at ISOTON II. The "flush aperture tube after measurement" is checked. With the dedicated software, on the "Set conversion from pulse to particle diameter" screen, the bin interval is set at the logarithmic particle diameter, the particle diameter bin is set at 256 particle diameter bins, and the particle diameter range is set at 2 μm to 60 μm. A specific measuring method is described as follows.

(1) About 200 ml of the electrolytic aqueous solution is placed in a 250 ml glass round-bottomed beaker dedicated to Multisizer 3. The beaker is set on a sample stand. The electrolytic aqueous solution is stirred counterclockwise at 24 rotations/sec with a stirring rod. Dirt and air bubbles in the aperture tube are removed by the function "Flush aperture" of the dedicated software.

(2) About 30 ml of the electrolytic aqueous solution is placed in a 100 ml glass flat-bottomed beaker. About 0.3 ml of a diluted solution of a dispersant "CONTAMINON N" (trade name, 10% by mass aqueous solution of a neutral detergent for washing a precision measurement apparatus (pH: 7) composed of a nonionic surfactant, an anionic surfactant, and an organic builder, available from Wako Pure Chemical Industries, Ltd.) is added to the electrolytic aqueous solution. The diluted solution is prepared by diluting "CONTAMINON N" with ion exchange water about 3 times by mass.

(3) An ultrasonic disperser "Ultrasonic Dispersion System Tetora 150" (trade name, available from Nikkaki-Bios Co., Ltd.) is prepared. The ultrasonic disperser has an electrical output of 120 W and includes two incorporated oscillators having an oscillating frequency of 50 kHz with the phase of one oscillator being shifted 180° from the phase of the other oscillator. About 3.3 l of ion exchange water is placed in a water bath of the ultrasonic disperser, and about 2 ml of CONTAMINON N is added in the water bath.

(4) The beaker in (2) is set to a beaker fixing hole of the ultrasonic disperser to operate the ultrasonic disperser. The height of the beaker is adjusted so as to maximize the oscillating state of the surface of the electrolytic aqueous solution in the beaker.

(5) While the electrolytic aqueous solution in the beaker of (4) is irradiated with ultrasonic waves, a toner (about 10 mg) is added to the electrolytic aqueous solution little by little, and is dispersed. The ultrasonic dispersion is continued for another 60 seconds. During the ultrasonic dispersion, the temperate of water in the water bath is properly adjusted to 10° C. or more and 40° C. or less.

(6) The electrolytic aqueous solution having the dispersed toner (5) is added dropwise to the round-bottomed beaker set on the sample stand in (1) with a pipette, and the concentration for measurement is adjusted to be about 5% by mass. The measurement is performed until the number of particles measured reaches 50000.

(7) The data measured is analyzed with the dedicated software attached to the analyzer, and the mass average particle diameter (D4) is calculated. When graph/% by volume is set with the dedicated software, the "average diameter" on the "analysis/volume statistical value (arithmetic average)" screen is the mass average particle diameter (D4).

[9] Method of Measuring Number Average Particle Diameter (D1) of Primary Particles of Silica Fine Particles The number average particle diameter of primary particles of the silica fine particles is calculated from images of the silica fine particles on the surfaces of the toner particles. The images are photographed with a Hitachi super high resolution field-emission scanning electron microscope S-4800 (trade name, available from Hitachi High-Technologies Corporation). The images are photographed with S-4800 on the following conditions.

(1) Preparation of Sample

A conductive paste is slightly applied onto a sample stand (aluminum sample stand: 15 mm×6 mm), and a toner is sprayed on the paste. An excess of the toner is removed from the sample stand by blowing air, and the sample is sufficiently dried. The sample stand is set in a sample holder, and the height of the sample stand is adjusted to 36 mm with a sample height gauge.

(2) Setting Conditions on Observation with S-4800

The number average particle diameter of primary particles of the silica fine particles is calculated from the image obtained by observation of a backscattered electron image with S-4800. Charge up of the silica fine particles barely occurs in the backscattered electron image compared to a secondary electron image, and the particle diameters of the silica fine particles can be measured accurately.

Liquid nitrogen is injected to an anti-contamination trap mounted on a mirror body of S-4800 until liquid nitrogen overflows, and is left for 30 minutes. "PCSTEM" of S-4800 is operated to flush (clean FE chips as an electron source). An accelerating voltage display unit in a control panel on the screen is clicked, and the [flushing] button is pressed to open a flushing operating dialogue. When it is confirmed that the flushing strength is 2, the flushing is executed. It is confirmed that the emission current by the flushing is 20 to 40 μA. The sample holder is inserted into a sample chamber of the mirror body of S-4800. The [origin] on the control panel is pressed to move the sample holder to a position for observation.

The accelerating voltage display unit is clicked to open an HV setting dialogue, and the accelerating voltage is set at [0.8 kV] and the emission current is set at [20 μA]. The signal selection is set to [SE] in a tab [Basic] of the operation panel, and [UP (U)] and [+BSE] is selected for the SE detector. [L.A.100] is selected in the selection box on the right of [+BSE] to select a mode of observation with the backscattered electron image. In the tab [Basic] of the operation panel, the probe current in the electron optical system condition block is set to [Normal], the focus mode is set to [UHR], and WD is set to [3.0 mm]. The [ON] button of the accelerating voltage display unit on the control panel is pressed to apply an accelerating voltage.

(3) Calculation of Number Average Particle Diameter (D1) (Da) of Primary Particles of Silica Fine Particles A place in the magnification display unit on the control panel is dragged to set the magnification to be 100000 (100 k) times. The focus knob [COARSE] on the operation panel is turned. When the focusing is obtained to some extent, the alignment of the aperture is adjusted. [Align] on the control panel is clicked to display the alignment dialogue, and select [Beam]. The STIGMA/ALIGNMENT knob (X,Y) on the operation panel is turned to move the displayed beam to the center of the concentric circle. Next, [Aperture] is selected. The STIGMA/ALIGNMENT knob (X,Y) is turned one by one to perform alignment so as to stop or minimize the movement of the image. The aperture dialogue is closed, and focusing is obtained by autofocusing. This operation is further repeated twice to obtain focusing.

Subsequently, the particle diameters of at least 300 silica fine particles on the surfaces of the toner particles are measured to determine the average particle diameter. Here, some silica fine particles are present as clots. Accordingly, the largest diameters of the silica fine particles determined as primary particles are determined, and the largest diameters thereof are arithmetically averaged to obtain the number average particle diameter (D1) (da) of primary particles of the silica fine particles.

[10] Method of Measuring Average Circularity of Toner Particles

The average circularity of the toner particles is measured with a flow type particle image analyzer "FPIA-3000" (trade name, available from Sysmex Corporation) on the conditions on measurement and analysis during calibration. A specific measuring method is described as follows. First, about 20 ml of ion exchange water from impurity solid products are preliminarily removed is placed in a glass container. About 0.2 ml of a diluted solution of a dispersant "CONTAMINON N" (trade name, 10% by mass aqueous solution of a neutral detergent for washing a precision measurement apparatus (pH: 7) composed of a nonionic surfactant, an anionic surfactant, and an organic builder, available from Wako Pure Chemical Industries, Ltd.) is added to the ion exchange water. The diluted solution is prepared by diluting "CONTAMINON N" with ion exchange water about 3 times by mass. A sample for measurement (about 0.02 g) is added, and is dispersed with an ultrasonic disperser for 2 minutes to prepare a dispersion liquid for measurement. At this time, the dispersion liquid is properly cooled to control the temperature of the dispersion liquid to be 10° C. or more and 40° C. or less. The ultrasonic disperser used is a desktop ultrasonic washing and dispersing machine ("VS-150" (trade name, available from VELVO-CLEAR K.K.)) having an oscillating frequency of 50 kHz and an electrical output of 150 W. A predetermined amount of ion exchange water is placed in the water bath, and about 2 ml of the CONTAMINON N is added into the water bath.

In the measurement, the flow type particle image analyzer provided with an object lens "UPlan Apro" (magnification: 10 times, the number of openings: 0.40) is used. A particle sheath "PSE-900A" (trade name, available from Sysmex Corporation) is used as a sheath solution. The dispersion liquid prepared according to the procedure is introduced into the flow type particle image analyzer, and 3000 toner particles are measured in an HPF measuring mode and a total count mode. The binarized threshold during particle analysis is 85%. The particle diameter for analysis is limited to an equivalent circle diameter 1.985 μm or more and less than 39.69 μm to determine the average circularity of the toner particles.

In the measurement, the focus is automatically adjusted with a standard latex particle (such as "RESEARCH AND TEST PARTICLES Latex Microsphere Suspensions 5200A available from Duke Scientific Co." diluted with ion exchange water) before the measurement is started. Subsequently, the focus is adjusted every 2 hours from the start of the measurement.

In the present invention, a flow type particle image measurement apparatus corrected and certified by Sysmex Corporation is used. The measurement is performed on the conditions on measurement and analysis set when corrected and certified by Sysmex Corporation, except that the particle diameter for analysis is limited to an equivalent circle diameter 1.985 μm or more and less than 39.69 μm.

The principle of measurement employed by the flow type particle image measurement apparatus "FPIA-3000" (trade name, available from Sysmex Corporation) is that flowing particles are photographed as a still image and the image is analyzed. A sample placed in a sample chamber is fed to a flat sheath flow cell with a sample suction syringe. The sample fed to the flat sheath flow cell is sandwiched between flows of a sheath solution to form a flat flow. The sample passing through the flat sheath flow cell is irradiated with a strobe light at intervals of 1/60 seconds. Thereby, flowing particles can be photographed as a still image. The flow can be focused and photographed because the flow is flat. The image of particles is taken with a CCD camera, and is subjected to image processing at an image processing resolution of 512×512 pixels (0.37×0.37 μm per pixel). Each particle image is subjected to outline extraction to measure the projected area S and circumferential length L of the particle image.

Next, the equivalent circle diameter and the circularity are determined from the area S and the circumferential length L. The equivalent circle diameter refers to a diameter of a circle having the same area as the projected area of the particle image. The circularity is defined as a value obtained by dividing the circumferential length of a circle determined from the equivalent circle diameter by a circumferential length of a projected image of the particle. The circularity is calculated from the following expression:

$$\text{circularity}=2\times(\pi\times S)1/2/L$$

When the particle image is circular, the circularity is 1.000. As the degree of unevenness of the outer periphery of the particle image is larger, the circularity has a smaller value. After the circularity of each particle is calculated, a range of a circularity from 0.200 to 1.000 is divided into 800, and the arithmetic average value of the obtained circularities is calculated. The value is defined as the average circularity.

[11] Method of Measuring Apparent Density of Silica Fine Particles

In the measurement of the apparent density of the silica fine particles, a sample for measurement placed on a paper is slowly added into a 100 ml measuring cylinder until the sample reaches 100 ml. The difference between the mass of the measuring cylinder before addition of the sample and that after addition of the sample is determined from the following expression. The sample is carefully added into the measuring cylinder so as not to hit the paper.

apparent density (g/L)=(mass (g) when 100 ml of the sample is added)/0.1

[12] Method of Measuring True Specific Gravity of Toner and Silica Fine Particles The true specific gravity of the toner and that of the silica fine particles are measured with a dry automatic densitometer Auto Pycnometer (trade name, available from Yuasa Ionics Inc.). The conditions are as follows.

Cell: SM cell (10 ml)

Amount of the sample: about 2.0 g (toner), 0.05 g (silica fine particles)

The measurement method measures the true specific gravities of a solid and a liquid according to gas displacement. The gas displacement as well as fluid displacement is based on Archimedes' principle. The gas displacement uses a gas (argon gas) as a displacement medium and has high precision in the measurement of micropores.

[13] Method of Measuring Fixation Rate of Silica Fine Particles with Silicone Oil in Terms of Amount of Carbon (Extraction of Free Silicone Oil)

(1) Silica fine particles (0.50 g) and chloroform (40 ml) are placed in a beaker, and are stirred for 2 hours.

(2) Stirring is stopped, and the mixture is left as it is for 12 hours.

(3) The sample is filtered, and the product is washed with chloroform (40 ml) three times.

(Measurement of Amount of Carbon)

Under an oxygen stream, the sample is burned at 1100° C., and the amounts of CO and $CO_2$ generated are measured by absorbance of IR to determine the amount of carbon in the sample. The amounts of carbon are compared before and after the extraction of silicone oil, and the fixation rate of silicone oil in terms of the amount of carbon is calculated as follows.

(1) A sample (0.40 g) is placed in a cylindrical metal mold, and is pressed.

(2) The pressed sample (0.15 g) is precisely weighed, is placed on a board for burning, and is measured with a HORIBA EMA-110 (trade name).

(3) The value obtained from ([amount of carbon after extraction of silicone oil]/[amount of carbon before extraction of silicone oil]×100) is defined as the fixation rate of silicone oil in terms of the amount of carbon.

When the silica fine particles are hydrophobized with a silane compound or the like and are surface treated with silicone oil, the amount of carbon in the sample is measured after the hydrophobization with a silane compound or the like. After the treatment with silicone oil, the amount of carbon before the extraction of silicone oil is compared to that after the extraction of silicone oil. The fixation rate in terms of the amount of carbon derived from silicone oil is calculated as follows.

(4) The value obtained from [amount of carbon after extraction of silicone oil]/[(amount of carbon before extraction of silicone oil−amount of carbon after hydrophobization with silane compound)]×100) is defined as the fixation rate of silicone oil in terms of the amount of carbon.

When the silica fine particles are hydrophobized with a silane compound or the like after the surface treatment with silicone oil, the fixation rate in terms of the amount of carbon derived from silicone oil is calculated as follows.

(5) The value obtained from ([(amount of carbon after extraction of silicone oil−amount of carbon after hydrophobization with silane compound)]/[amount of carbon before extraction of silicone oil]×100) is defined as the fixation rate of silicone oil in terms of the amount of carbon.

The present invention can provide a developing apparatus and a developing method that can suppress generation of fogging and insufficient control caused by charge up and form high-quality images even under a high temperature and high humidity environment and a low temperature and low humidity environment. The present invention can also provide an image forming apparatus and an image forming method that can form high-quality images stably.

EXAMPLES

The present invention will now be described in detail by way of Examples, but the present invention will not be limited to these. The number of parts and % in Examples and Comparative Examples all are in terms of mass, unless otherwise specified.

(Preparation of Elastic Member)

A primer (trade name, DY35-051; available from Dow Corning Toray Co., Ltd.) was applied to a substrate, and was burned. The substrate was a ground aluminum cylindrical tube having a diameter (outer diameter) of 10 mm and an arithmetic average roughness Ra of 0.2 μm. The substrate was disposed in a metal mold, and an addition type silicone rubber composition containing a mixture of the following materials was injected into a cavity formed in the metal mold.

liquid silicone rubber material (trade name, SE6724 A/B; available from Dow Corning Toray Co., Ltd.) 100 parts by mass, carbon black (trade name, TOKABLACK #4300; available from Tokai Carbon Co., Ltd.) 15 parts by mass, silica powder as a heat resistance assigning agent 0.2 parts by mass, platinum catalyst 0.1 parts by mass.

Subsequently, the metal mold was heated to vulcanize silicone rubber at a temperature of 150° C. for 15 minutes and cure silicone rubber. The substrate having the cured silicone rubber layer on its circumferential surface was removed from the metal mold. The substrate was further heated at a temperature of 180° C. for one hour to complete the curing reaction of the silicone rubber layer. Thereby, a base layer containing silicone rubber and having a thickness of 0.5 mm and a diameter of 11 mm was formed on the outer periphery of the substrate. Thus, an elastic member was prepared.

(Preparation of Coating Material 1)

<Synthesis of Isocyanate Group-Terminated Prepolymer A-1>

Under a nitrogen atmosphere, in a reaction container, butylene adipate polyol (trade name: NIPPOLAN 4010; available from Nippon Polyurethane Industry Co., Ltd.) (100.0 parts by mass) was gradually added dropwise to polymeric MDI (trade name: Millionate MR, available from Nippon Polyurethane Industry Co., Ltd.) (33.8 parts by mass) while the inner temperature of the reaction container was kept at 65° C. After the addition was completed, the mixture was reacted at a temperature of 65° C. for 2 hours. The reaction mixture was cooled to room temperature to prepare isocyanate group-terminated prepolymer A-1 having a content of an isocyanate group of 4.3% by mass.

The materials for coating material 1 used were isocyanate group-terminated prepolymer A-1 (97.0 parts by mass), pentaerythritol (3.0 parts by mass), carbon black (trade name, MA230; available from Mitsubishi Chemical Corporation) (18.0 parts by mass), and a urethane resin fine particle (trade name, Art-pearl C-400; available from Negami Chemical Industrial Co., Ltd.) (20.0 parts by mass). Methyl ethyl ketone (MEK) was added to the materials to adjust the concentration of the solid content to 40% by mass. The mixture was dispersed for 2 hours with a sand mill (trade name: a sand grinder LSG-4U-08, available from Aimex Co., Ltd.) (glass beads having a diameter of 1 mm were used as a medium particle). Subsequently, the glass beads were separated with a sieve, and MEK was added such that the concentration of the solid content was 30% by mass. Coating material 1 was prepared. The volume resistivity of coating material 1 was $5.7\times10^{6}$ Ω·cm.

(Preparation of Coating Material 2)

<Synthesis of Isocyanate Group-Terminated Prepolymer A-2>

Under a nitrogen atmosphere, in a reaction container, polypropylene glycol polyol (trade name: EXCENOL 4030; available from ASAHI GLASS CO., LTD.) (100.0 parts by mass) was gradually added dropwise to tolylene diisocyanate (TDI) (trade name: COSMONATE T80; available from Mitsui Chemicals, Inc.) (17.7 parts by mass) while the inner temperature of the reaction container was kept at 65° C. After the addition was completed, the mixture was reacted at a temperature of 65° C. for 2 hours. The reaction mixture was cooled to room temperature to prepare isocyanate group-terminated prepolymer A-2 having a content of an isocyanate group of 3.8% by mass.

<Synthesis of Amino Compound B-1>

In a reaction container provided with a stirring apparatus, a thermometer, an adding apparatus, and a temperature adjusting apparatus, diethylenetriamine (100.0 parts by mass) and ethanol (100 parts by mass) were heated to 40° C. while being stirred. Next, while the reaction temperature was kept at 60° C. or less, ethylene oxide (235.0 parts by mass) was gradually added dropwise over 30 minutes. The mixture was further stirred for 1 hour to be reacted. A reaction mixture was prepared. The reaction mixture was heated under reduced pressure to distill off ethanol. Amino compound B-1 (276 g) was prepared.

Coating material 2 was prepared in the same manner as in coating material 1 except that the isocyanate group-terminated prepolymer A-2 and the amino compound B-1 were used and the materials were mixed in the amounts shown in Table 1. The volume resistivity of coating material 2 was $7.4\times10^{8}$ Ω·cm.

(Preparation of Coating Material 3)

<Synthesis of Hydroxyl Group-Terminated Prepolymer B-2>

ϵ-Caprolactone (80.4% by mass), trimethylolpropane (19.6% by mass), and titanium tetra-n-butoxide as a catalyst were placed in a glass flask with a stirrer, and were reacted under a nitrogen atmosphere at 180° C. for 7 hours, and then at 200° C. for 3 hours. The product was spontaneously cooled to prepare Polyester polyol (1) having an average functionality of 3.5. Polyester polyol (1) and a mixture (24A100:D101=0.38:0.62 (mass ratio)) of a polyfunctional isocyanate DURANATE 24A100 (trade name, available from Asahi Kasei Chemicals Corporation) and a bifunctional isocyanate DURANATE D101 (trade name, available from Asahi Kasei Chemicals Corporation) were compounded to make a ratio of OH:NCO at 2:1. The mixture was vigorously stirred at 100° C. for 6 hours to prepare hydroxyl group-terminated prepolymer B-2 having an average functionality of 4.5.

<Synthesis of Isocyanate Group-Terminated Prepolymer A-3>

ϵ-Caprolactone (95.7% by mass), trimethylolpropane (4.3% by mass), and titanium tetra-n-butoxide as a catalyst were placed in a glass flask with a stirrer, and were reacted under a nitrogen atmosphere at 180° C. for 7 hours, and then at 200° C. for 3 hours. The product was spontaneously cooled to prepare polyester polyol (2) having an average functionality of 2.4. Polyester polyol (2) and a mixture (24 A100:D101=0.38:0.62 (mass ratio)) of a polyfunctional isocyanate DURANATE 24A100 (trade name, available from Asahi Kasei Chemicals Corporation) and a bifunctional isocyanate DURANATE D101 (trade name, available from Asahi Kasei Chemicals Corporation) were compounded to make a ratio of OH:NCO at 1:2. The mixture was vigorously stirred at 100° C. for 6 hours to prepare isocyanate group-terminated prepolymer A-3 having an average functionality of 3.5.

Coating material 3 was prepared in the same manner as in coating material 1 except that the hydroxyl group-terminated prepolymer B-2 and the isocyanate group-terminated prepolymer A-3 were used and the materials were mixed in the amounts shown in Table 1. The volume resistivity of coating material 3 was $9.7\times10^{7}$ Ω·cm.

(Preparation of Coating Material 4)

Coating material 4 was prepared in the same manner as in coating material 1 except that isocyanate group-terminated prepolymer A-2 and amino compound B-1 were used and the materials were mixed in the amounts shown in Table 1. The volume resistivity of coating material 4 was $3.5\times10^{14}$ Ω·cm.

(Preparation of Coating Material 5)

Coating material 5 was prepared in the same manner as in coating material 1 except that isocyanate group-terminated prepolymer A-3, hydroxyl group-terminated prepolymer B-2 were used and the materials were mixed in the amounts shown in Table 1. The volume resistivity of coating material 5 was $1.3\times10^{12}$ Ω·cm.

(Preparation of Coating Material 6)

Coating material 6 was prepared in the same manner as in coating material 1 except that isocyanate group-terminated prepolymer A-1 and pentaerythritol were used and the materials were mixed in the amounts shown in Table 1. The volume resistivity of coating material 6 was $3.8\times10^{11}$ Ω·cm.

(Preparation of Coating Material 7)

A modified silicone resin (trade name: ES-1001N, available from Shin-Etsu Chemical Co., Ltd.) was diluted with xylene to have a concentration of the solid content of 5%. Coating material 7 was prepared. The volume resistivity of coating material 7 was $5.7\times10^{13}$ Ω·cm.

(Preparation of Coating Material 12)

Coating material 12 was prepared in the same manner as in coating material 1 except that isocyanate group-terminated prepolymer A-2, amino compound B-1, and a urethane resin particle (trade name: Art-pearl C-400, available from Negami Chemical Industrial Co., Ltd.) were used and the materials were mixed in the amounts shown in Table 1. The volume resistivity of coating material 12 was $6.8\times10^{12}$ Ωcm.

TABLE 1

| | Resin | | | | Conductive particle | | Roughening particle | | |
|---|---|---|---|---|---|---|---|---|---|
| | Material 1 | | Material 2 | | | | | | |
| | Types | Parts by mass | Types | Parts by mass | Types | Parts by mass | Types | Parts by mass | Volume resistivity (Ω · cm) |
| Coating material 1 | A-1 | 97.0 | Pentaerythritol | 3.0 | Carbon black MA230 | 18.0 | Urethane resin particle Art-pearl C-400 | 20.0 | $5.7 \times 10^{6}$ |
| Coating material 2 | A-2 | 94.9 | B-1 | 5.1 | Carbon black MA230 | 18.0 | Urethane resin particle Art-pearl C-400 | 20.0 | $7.4 \times 10^{8}$ |
| Coating material 3 | A-3 | 23.1 | B-2 | 76.9 | Carbon black MA100 | 15.4 | Urethane resin particle Art-pearl C-400 | 11.5 | $9.7 \times 10^{7}$ |
| Coating material 4 | A-2 | 94.9 | B-1 | 5.1 | — | — | — | — | $3.5 \times 10^{14}$ |
| Coating material 5 | A-3 | 23.1 | B-2 | 76.9 | — | — | — | — | $1.3 \times 10^{12}$ |
| Coating material 6 | A-1 | 97.0 | Pentaerythritol | 3.0 | — | — | — | — | $3.8 \times 10^{11}$ |
| Coating material 7 | Modified silicon resin ES-1001N | 100.0 | — | — | — | — | — | — | $5.7 \times 10^{13}$ |
| Coating material 8 | Polycarbonate resin Z400 | 100.0 | — | — | — | — | — | — | $9.7 \times 10^{15}$ |
| Coating material 9 | Polyester resin VYLON 200 | 100.0 | — | — | — | — | — | — | $1.4 \times 10^{16}$ |
| Coating material 10 | Acrylic resin NK-380 | 100.0 | — | — | — | — | — | — | $8.5 \times 10^{13}$ |
| Coating material 11 | Polyolefin | 100.0 | — | — | — | — | — | — | $7.0 \times 10^{15}$ |
| Coating material 12 | A-2 | 94.9 | B-1 | 5.1 | — | — | Urethane resin particle Art-pearl C-400 | 20.0 | $6.8 \times 10^{12}$ |

(Preparation of Coating Material 8)

A carbonate resin (trade name: Iupilon Z400, available from Mitsubishi Engineering-Plastics Corporation) was diluted with monochlorobenzene to have a concentration of the solid content of 5%. Coating material 8 was prepared. The volume resistivity of coating material 8 was $9.7\times10^{15}$ Ω·cm.

(Preparation of Coating Material 9)

A polyester resin (trade name: VYLON200, available from TOYOBO CO., LTD.) was diluted with MEK to have a concentration of the solid content of 5%. Coating material 9 was prepared. The volume resistivity of coating material 9 was $1.4\times10^{16}$ Ω·cm.

(Preparation of Coating Material 10)

An aminoethylated acrylic resin (trade name: POLYMENT NK-380, available from NIPPON SHOKUBAI CO., LTD.) was diluted with MEK to have a concentration of the solid content of 5%. Coating material 10 was prepared. The volume resistivity of coating material 10 was $8.5\times10^{13}$ Ω·cm.

(Preparation of Coating Material 11)

A polyolefin resin (trade name: SURFLEN, available from Mitsubishi Chemical Corporation) was diluted with toluene to have a concentration of the solid content of 10%. Coating material 11 was prepared. The volume resistivity of coating material 11 was $7.0\times10^{15}$ Ω·cm.

(Preparation of Developing Roller T1)

Portions not having the base layer formed in the elastic member were masked, and the elastic member was vertically disposed. The elastic member was rotated at 1500 rpm, and coating material 1 was applied to the elastic member while a spray gun was being moved down at 30 mm/s. Subsequently, the coating layer was cured and dried in a hot air drying furnace by heating at a temperature of 180° C. for 20 minutes to form an intermediate layer. Thereby, roller t1 was prepared. The intermediate layer of roller t1 had a thickness of 8 μm.

Furthermore, coating material 4 was applied onto the surface of roller t1 in the same manner, and the coating layer was cured and dried to form a coverage portion. Thereby, developing roller T1 was prepared. The coverage portion of developing roller T1 had an average thickness of 3 μm and a covering rate of 100%. The volume resistivity of the coverage portion was $2.5\times10^{13}$ Ω·cm, and Ra was 2.51 μm. The materials for the intermediate layer and the coverage portion of developing roller T1 and the physical properties thereof are shown in Table 2.

(Preparation of Developing Rollers T2 to T5, T7 to T11, T13 to T18, T20, and T21)

Developing rollers T2 to T5, T7 to T11, T13 to T18, T20, and T21 were prepared in the same manner as in developing roller T1 except that the materials were changed as shown in Table 2. In preparation of developing roller T10, both ends of the roller were masked, and the roller was dipped in the coating material to prepare a coverage portion. The materials for the intermediate layer and the coverage portion of the respective developing rollers and the physical properties thereof are shown in Table 2.

(Preparation of Developing Rollers T6, T12, and T19)

An intermediate layer was formed in the same manner as in developing roller T1. Subsequently, the roller excluding the surface of the intermediate layer was masked. An aluminum oxide film as a coverage portion was formed on the intermediate layer by vacuum deposition of $Al_2O_3$ granules in which the granules were vaporized by heating with electron beams and were deposited on the intermediate layer. In developing rollers T6, T12, and T19, the thickness of the coverage portion was varied by changing the amount of the granules to be treated. The materials for the intermediate layer and the coverage portion of the respective developing rollers and the physical properties thereof are shown in Table 2.

TABLE 2

| | Intermediate layer | | | Coverage portion | | | | |
|---|---|---|---|---|---|---|---|---|
| | Material | Volume resistivity Ω · cm | Average thickness μm | Material | Volume resistivity Ω · cm | Average thickness μm | Covering rate % | Ra μm |
| Developing roller T1 | Coating material 1 | $5.7 \times 10^6$ | 8.0 | Coating material 4 | $3.5 \times 10^{14}$ | 3.1 | 100 | 2.57 |
| Developing roller T2 | Coating material 2 | $7.4 \times 10^8$ | 7.9 | Coating material 5 | $1.3 \times 10^{12}$ | 2.8 | 100 | 2.45 |
| Developing roller T3 | Coating material 1 | $5.7 \times 10^6$ | 8.0 | Coating material 4 | $3.5 \times 10^{14}$ | 0.3 | 100 | 2.59 |
| Developing roller T4 | Coating material 1 | $5.7 \times 10^6$ | 8.0 | Coating material 4 | $3.5 \times 10^{14}$ | 4.9 | 100 | 2.51 |
| Developing roller T5 | Coating material 1 | $5.7 \times 10^6$ | 8.0 | Coating material 6 | $3.8 \times 10^{11}$ | 3.3 | 100 | 2.53 |
| Developing roller T6 | Coating material 1 | $5.7 \times 10^6$ | 8.0 | Alumina | $7.5 \times 10^{10}$ | 1.0 | 100 | 2.81 |
| Developing roller T7 | Coating material 1 | $5.7 \times 10^6$ | 8.0 | Coating material 7 | $5.7 \times 10^{13}$ | 3.0 | 70 | 2.55 |
| Developing roller T8 | Coating material 1 | $5.7 \times 10^6$ | 8.0 | Coating material 8 | $9.7 \times 10^{15}$ | 3.2 | 100 | 2.49 |
| Developing roller T9 | Coating material 1 | $5.7 \times 10^6$ | 8.0 | Coating material 9 | $1.4 \times 10^{16}$ | 2.7 | 100 | 2.50 |
| Developing roller T10 | Coating material 1 | $5.7 \times 10^6$ | 8.0 | Coating material 10 | $8.5 \times 10^{13}$ | 3.1 | 100 | 2.53 |
| Developing roller T11 | Coating material 1 | $5.7 \times 10^6$ | 8.0 | Coating material 11 | $7.0 \times 10^{15}$ | 3.1 | 100 | 2.53 |
| Developing roller T12 | Coating material 1 | $5.7 \times 10^6$ | 8.0 | Alumina | $1.5 \times 10^8$ | 1.8 | 100 | 2.74 |
| Developing roller T13 | Coating material 1 | $5.7 \times 10^6$ | 8.0 | Coating material 4 | $3.5 \times 10^{14}$ | 0.3 | 31 | 2.48 |
| Developing roller T14 | Coating material 1 | $5.7 \times 10^6$ | 8.0 | Coating material 4 | $3.5 \times 10^{14}$ | 0.3 | 22 | 2.44 |
| Developing roller T15 | — | — | — | Coating material 12 | $4.1 \times 10^{12}$ | 4.8 | 100 | 2.67 |
| Developing roller T17 | Coating material 4 | $3.5 \times 10^{14}$ | 3.0 | Coating material 1 | $5.7 \times 10^6$ | 8.0 | 100 | 2.64 |
| Developing roller T18 | Coating material 1 | $5.7 \times 10^6$ | 8.0 | Coating material 6 | $3.8 \times 10^{11}$ | 7.2 | 100 | 2.16 |
| Developing roller T19 | Coating material 1 | $5.7 \times 10^6$ | 8.0 | Alumina | $2.5 \times 10^7$ | 2.1 | 100 | 2.63 |
| Developing roller T20 | Coating material 1 | $5.7 \times 10^6$ | 8.0 | Coating material 4 | $3.5 \times 10^{14}$ | 0.1 | 100 | 2.57 |
| Developing roller T21 | Coating material 1 | $5.7 \times 10^6$ | 8.0 | Coating material 4 | $3.5 \times 10^{14}$ | 7.2 | 100 | 2.57 |

(Preparation of Toner Particle 1)

<Preparation of Magnetic Substance 1>

A sodium hydroxide solution (1.00 to 1.10 equivalents relative to an iron element), $P_2O_5$ (0.15% by mass in terms of a phosphorus element relative to an iron element), and $SiO_2$ (0.50% by mass in terms of a silicon element relative to an iron element) were mixed with an aqueous solution of ferrous sulfate to prepare an aqueous solution containing ferrous hydroxide. The pH of the aqueous solution was adjusted to 8.0. An oxidation reaction was performed at 85° C. while air was being fed. A slurry solution having seed crystals was prepared.

Next, an aqueous solution of ferrous sulfate was added to the slurry solution in an amount of 0.90 to 1.20 equivalents relative to the initial alkali amount (sodium component in sodium hydroxide). Then, the pH of the slurry solution was kept at 7.6, and the oxidation reaction was performed while air was being fed. A slurry solution containing magnetic iron oxide was prepared. After filtration and washing of the slurry solution, the moisture slurry solution was extracted once. At this time, a small amount of the moisture sample was taken, and the amount of moisture was measured. Next, the moisture sample was placed in another aqueous medium without drying, and was stirred. The slurry was redispersed with a pin mill while being circulated. The pH of the redispersed liquid was adjusted to about 4.8.

Under stirring, 1.6 parts by mass of an n-hexyltrimethoxysilane coupling agent was added relative to 100 parts by mass of magnetic iron oxide (the amount of magnetic iron oxide was calculated by subtracting the moisture content from the amount of the moisture sample), and was hydrolyzed. Subsequently, the mixture was sufficiently stirred, the pH of the dispersion liquid was adjusted to 8.6, and the surface treatment was performed. The generated hydrophobic magnetic substance was filtered through a filter press, and was washed with a large amount of water. The magnetic substance was dried at 100° C. for 15 minutes and at 90° C. for 30 minutes. The resulting particles are ground to prepare Magnetic substance 1 having a volume average particle diameter of 0.21 μm.

<Synthesis of Polyester Resin 1>

The following components were placed in a reaction tank provided with a cooling tube, a stirrer, and a nitrogen introducing pipe, and were reacted at 230° C. under a nitrogen stream for 10 hours while water was being distilled off.

Bisphenol A propylene oxide 2 mol adduct: 75 parts by mass

Bisphenol A propylene oxide 3 mol adduct: 25 parts by mass

Terephthalic acid: 100 parts by mass

Titanium catalyst (titanium dihydroxybis(triethanolaminate)): 0.25 parts by mass Next, the reaction was made under a reduced pressure of 5 to 20 mmHg. When the acid value reached 2 mgKOH/g or less, the product was cooled to 180° C. Trimellitic anhydride (10 parts by mass) was added. The reaction was performed under sealed normal pressure for 2 hours. The reaction was extracted, was cooled to room temperature, and was ground to prepare Polyester resin 1. The resulting Polyester resin 1 had a main peak molecular weight (Mp) of 10500, which was determined by gel permeation chromatography (GPC).

An aqueous solution of 0.1 mol/L $Na_3PO_4$ (450 parts by mass) was added to ion exchange water (720 parts by mass), and the mixture was heated to 60° C. An aqueous solution of 1.0 mol/L $CaCl_2$ (67.7 parts by mass) was added to prepare an aqueous medium containing a dispersion stabilizer.

The following formulation was uniformly dispersed and mixed with an Attritor (available from Mitsui Miike Kakoki K.K.) to prepare a polymerizable monomer composition. The resulting polymerizable monomer composition was heated to 60° C. A Fischer-Tropsch wax (melting point: 74° C., number average molecular weight Mn: 500) (15.0 parts by mass) was added, was mixed, and was dissolved. A polymerization initiator dilauroyl peroxide (7.0 parts by mass) was dissolved to prepare a toner composition.

Styrene: 78.0 parts by mass n-butyl acrylate: 22.0 parts by mass

Divinylbenzene: 0.6 parts by mass

Iron complex of a monoazo dye (T-77: available from HODOGAYA CHEMICAL CO., LTD.): 3.0 parts by mass Magnetic substance 1: 90.0 parts by mass Polyester resin 1: 5.0 parts by mass The toner composition was added to the aqueous medium, and was stirred at 60° C. under an $N_2$ atmosphere with a TK homomixer (available from PRIMIX Corporation) at 12000 rpm for 10 minutes to be granulated. Subsequently, the mixture was reacted at 74° C. for 6 hours while the mixture was being stirred with a paddle stirring blade. After the reaction was completed, the resulting suspension was cooled, and hydrochloric acid was added to wash the suspension. The suspension was filtered, and was dried to prepare Toner particle 1. The resulting magnetic toner toner particle 1 had a mass average particle diameter of 8.0 μm and an average circularity of 0.970 as shown in Table 3.

(Preparation of Toner Particle 2)

Toner particle 2 was prepared in the same manner as in toner particle 1 except that the granulation conditions were changed to have an average circularity of 0.938. The mass average particle diameter and the average circularity of toner particle 2 are shown in Table 3.

TABLE 3

| Toner particle | Mass average particle diameter (D4) (μm) | Average circularity |
|---|---|---|
| Toner particle 1 | 8.0 | 0.970 |
| Toner particle 2 | 8.0 | 0.938 |

<Preparation of Toner 1>

Toner particle 1 was subjected to external addition by mixing with an apparatus illustrated in FIG. 6. In the apparatus illustrated in FIG. 6, the inner circumferential portion of the main body casing 22 had a diameter of 130 mm and the treatment space 30 had a volume of $2.0\times10^{-3}$ $m^3$. The driving unit 29 had a rating power of 5.5 kW. The stirring member 24 had a shape illustrated in FIG. 7. In FIG. 7, the overlap width d of the stirring member 24*a* and the stirring member 24*b* was 0.25 D relative to the largest width D of the stirring member 24. The clearance formed by the stirring member 24 and the inner circumference of the main body casing 22 was 3.0 mm.

Toner particle 1 (100 parts by mass) and Silica fine particle 1 shown in Table 4 (number average particle diameter of primary particles of the silica raw material: 7 nm, BET specific surface area: 300 $m^2/g$, fixation rate of silicone oil in terms of the amount of carbon: 98%, apparent density: 25 g/L, number average particle diameter of primary particles of the silica fine particles after the surface treatment: 8 nm) (0.50 parts by mass) were placed in the apparatus illustrated in FIG. 6. Subsequently, Toner particle 1 and Silica fine particle 1 were pre-mixed to uniformly mix these. For the condition on the pre-mixing, the power of the driving unit 29 was 0.10 W/g (number of rotation of the driving unit 29: 150 rpm), and the treatment time was 1 minute.

After the pre-mixing was completed, external addition by mixing were performed. For the conditions on the external addition by mixing (hereinafter referred to as the conditions on external addition), the circumferential speed of the outermost end of the stirring member 24 was adjusted such that the power of the driving unit 29 was kept constant at 0.60 W/g (number of rotation of the driving unit 29: 1400 rpm), and the treatment time was set at 5 minutes. The conditions on the external addition are shown in Table 5. After completion of the external addition by mixing, coarse particles and the like were removed with a circular vibration sieving machine provided with a screen having a diameter of 500 mm and an opening of 75 μm to prepare Toner 1. Toner 1 was enlarged with a scanning electron microscope, and was observed. The number average particle diameter of primary particles of the silica fine particles 1 on the surfaces of the toner particles was measured. It was 8 nm. The physical properties of Toner 1 are shown in Table 5.

(Preparation of Toners 2 to 12)

Toners 2 to 12 were prepared in the same manner as in toner 1 except that the toner particle, the silica fine particles, the conditions on pre-mixing, and the conditions on external addition were changed as shown in Table 5. When a Henschel mixer was used as an external adding apparatus, Henschel mixer FM10C (Mitsui Miike Kakoki K.K.) was used.

TABLE 4

| Silica fine particles No. | Particle diameter (nm) | BET specific surface area of silica raw material ($m^2/g$) | Amount of silicone oil used in treatment based on 100 parts by mass of a silica raw material (parts by mass) | Kinematic viscosity of silicone oil (cSt) | Fixation rate of silicone oil in terms of amount of carbon (%) | Apparent density (g/L) |
|---|---|---|---|---|---|---|
| 1 | 8 | 300 | 20 | 50 | 98 | 25 |
| 2 | 8 | 300 | 20 | 20 | 98 | 25 |
| 3 | 8 | 100 | 17 | 50 | 98 | 40 |
| 4 | 8 | 380 | 28 | 50 | 98 | 20 |
| 5 | 8 | 300 | 15 | 50 | 98 | 25 |
| 6 | 8 | 300 | 20 | 50 | 70 | 25 |
| 7 | 8 | 50 | 15 | 50 | 98 | 55 |

TABLE 5

| Toner No. | Toner particle No. | Silica fine particle No. | Amount of toner particles to be added (parts by mass) | Amount of silica fine particles to be added (parts by mass) | External adding apparatus | Conditions on pre-mixing | Conditions on external addition | Covering rate × 1 (area %) | Diffusion index | −0.0042 * X1 + 0.62 |
|---|---|---|---|---|---|---|---|---|---|---|
| 1 | 1 | 1 | 100 | 0.50 | FIG. 6 | 0.10 W/g (150 rpm) | 0.60 W/g (1400 rpm) | 50 | 0.50 | 0.41 |
| 2 | 1 | 1 | 100 | 0.90 | FIG. 6 | 0.10 W/g (150 rpm) | 0.60 W/g (1400 rpm) | 75 | 0.42 | 0.31 |
| 3 | 1 | 2 | 100 | 0.60 | FIG. 6 | 0.10 W/g (150 rpm) | 0.60 W/g (1400 rpm) | 56 | 0.48 | 0.38 |
| 4 | 1 | 3 | 100 | 1.30 | FIG. 6 | 0.06 W/g (50 rpm) | 0.60 W/g (1400 rpm) | 58 | 0.64 | 0.38 |
| 5 | 1 | 4 | 100 | 0.40 | FIG. 6 | 0.06 W/g (50 rpm) | 0.60 W/g (1400 rpm) | 54 | 0.51 | 0.39 |
| 6 | 1 | 5 | 100 | 0.60 | FIG. 6 | 0.10 W/g (150 rpm) | 0.60 W/g (1400 rpm) | 56 | 0.48 | 0.38 |
| 7 | 1 | 6 | 100 | 0.60 | FIG. 6 | 0.10 W/g (150 rpm) | 0.60 W/g (1400 rpm) | 56 | 0.48 | 0.38 |
| 8 | 1 | 1 | 100 | 0.45 | FIG. 6 | 0.10 W/g (150 rpm) | 0.60 W/g (1400 rpm) | 47 | 0.52 | 0.42 |
| 9 | 1 | 1 | 100 | 0.40 | FIG. 6 | 0.10 W/g (150 rpm) | 0.60 W/g (1200 rpm) | 33 | 0.49 | 0.48 |
| 10 | 1 | 1 | 100 | 0.70 | Henschel mixer | Not pre-mixed | 4000 rpm | 50 | 0.36 | 0.41 |
| 11 | 2 | 1 | 100 | 1.30 | Henschel mixer | Not pre-mixed | 4000 rpm | 58 | 0.22 | 0.38 |
| 12 | 1 | 7 | 100 | 2.00 | Henschel mixer | Not pre-mixed | 4000 rpm | 50 | 0.47 | 0.41 |

Example 1

As an image forming apparatus for evaluation, a laser printer (trade name: LaserJet ProP1606, available from Hewlett-Packard Company) was modified as follows for used.

One of the modifications was that the voltage of the charging roller was changed such that the potential of the white portion in the electrophotographic photosensitive member was −650 V. The developing bias was changed from AC to DC. Another modification was that the developing bias was −500 V, the bright potential on the drum was −300 V, and the dark potential on the drum was −800 V. Namely, the image forming apparatus used in this evaluation has a Vcontrast of 200 V and Vback of 300 V.

In a process cartridge for the image forming apparatus, the cleaning blade disposed in contact with the electrophotographic photosensitive member in the process cartridge was removed. Six modified process cartridges were prepared. Developing carrying member T1 having a magnet roller therein was mounted on each of the process cartridges, and was filled with Toner 1.

Although the original developing apparatus mounted on the process cartridge for the image forming apparatus is a magnetic non-contact developing apparatus, it is converted into a magnetic contact developing apparatus by mounting Developing carrying member S-1 formed of an elastic roller having an outer diameter of 11 mm. The modified developing apparatus included a developing container and a toner layer thickness controlling member.

The following evaluations <1> and <4> were performed on the six process cartridges under a low temperature/low humidity environment (L/L) at 15° C. and 10% RH, a normal temperature/normal humidity environment (N/N) at 23° C. and 50% RH, and a high temperature/high humidity environment (H/H) at 32° C. and 85% RH.

<1> Image Density

Eleven sheets of a test chart having a print ratio of 5.5% were output. In the image on the 11th sheet, the densities of black solid spots having a diameter of 5 mm were measured with a reflection densitometer (trade name: RD918, available from Gretag Macbeth GmbH) by reflectance density measurement. The average value of the densities at any 10 points was defined as the image density.

<2> Insufficient Control

During evaluation of the image, the state of the toner coating disposed on the surface of the developing roller was observed, and the presence/absence of electrostatic aggregation of the toner caused by excessive charging of the toner (insufficient control) was visually observed. An image was evaluated as C if insufficient control was found in the image. An image was evaluated as B if insufficient control was found on the toner coating but was not found in the image. An image was evaluated as A if insufficient control was not found. When insufficient control occurred, other measurements were performed on portions having no insufficient control.

<3> Fogging (1) An image forming step of forming a white solid image in a paper of A4 size was continuously performed to obtain 11 white solid images. In the 11th white solid image, 10 white solid portions in the portion corresponding to one rotation of the developing carrying member were selected at random, and the reflectances were measured. The reflectance of an unused paper (average value of reflectances of 10 places) was subtracted from the lowest reflectance of the measured reflectances. The obtained value was defined as "Fog Density after formation of white solid image".

(2) An image forming step of forming a black solid image on a paper of A4 size was continuously performed to obtain 10 black solid images. Subsequently, one white solid image was output. In the white solid image, 10 white solid portions in the portion corresponding to one rotation of the developing carrying member were selected at random, the reflectances were measured. The reflectance of an unused paper (average value of reflectances of 10 places) was subtracted from the lowest reflectance of the 10 reflectances. The obtained value was defined as a "Fog Density after formation of black solid image".

The reflectance was measured with a reflectometer "TC-6DS" (trade name, available from Tokyo Denshoku Co., Ltd.).

<4> Charge Amount (1) In the evaluation in <3>(1), when the 11th white solid image was formed, the toner adhering to the developing carrying member was suctioned and collected with a metal cylindrical tube and a cylindrical filter. At this time, the charge amount Q stored in a capacitor through the metal cylindrical tube and the mass M of the collected toner were measured. From these values, the charge amount Q/M (mC/kg) per unit mass was calculated.

(2) In the evaluation in <3>(2), when the white solid image was formed, the toner adhering to the developing carrying member was suctioned and collected with a metal cylindrical tube and a cylindrical filter. At this time, the charge amount Q stored in a capacitor through the metal cylindrical tube and the mass M of the collected toner were measured. From these values, the charge amount Q/M (mC/kg) per unit mass was calculated.

The results of the evaluation are shown in Tables 7 and 8.

Examples 2 to 22

Comparative Examples 1 to 8

Evaluations were performed in the same manner as in Example 1 except that a toner and a developing roller shown in Table 6 were used. The results of evaluation are shown in Tables 7 and 8.

TABLE 6

| No. | Toner | Developing roller No. |
|---|---|---|
| Example 1 | Toner 1 | Developing roller T1 |
| Example 2 | Toner 1 | Developing roller T2 |
| Example 3 | Toner 1 | Developing roller T3 |
| Example 4 | Toner 1 | Developing roller T4 |
| Example 5 | Toner 5 | Developing roller T1 |
| Example 6 | Toner 4 | Developing roller T1 |
| Example 7 | Toner 3 | Developing roller T1 |
| Example 8 | Toner 7 | Developing roller T1 |
| Example 9 | Toner 8 | Developing roller T1 |
| Example 10 | Toner 2 | Developing roller T1 |
| Example 11 | Toner 8 | Developing roller T5 |
| Example 12 | Toner 8 | Developing roller T6 |
| Example 13 | Toner 1 | Developing roller T7 |
| Example 14 | Toner 1 | Developing roller T8 |
| Example 15 | Toner 1 | Developing roller T9 |
| Example 16 | Toner 1 | Developing roller T10 |
| Example 17 | Toner 1 | Developing roller T11 |
| Example 18 | Toner 1 | Developing roller T12 |
| Example 19 | Toner 1 | Developing roller T13 |
| Example 20 | Toner 1 | Developing roller T14 |
| Example 21 | Toner 1 | Developing roller T15 |
| Example 22 | Toner 12 | Developing roller T1 |
| Comparative Example 1 | Toner 9 | Developing roller T2 |
| Comparative Example 2 | Toner 8 | Developing roller T20 |
| Comparative Example 3 | Toner 8 | Developing roller T21 |
| Comparative Example 4 | Toner 8 | Developing roller T17 |
| Comparative Example 5 | Toner 8 | Developing roller T18 |
| Comparative Example 6 | Toner 8 | Developing roller T19 |
| Comparative Example 7 | Toner 10 | Developing roller T1 |
| Comparative Example 8 | Toner 11 | Developing roller T1 |

TABLE 7

| | Image density | | | Fog Density after formation of white solid image (%) | | | Fog Density after formation of black solid image (%) | | | Insufficient control | | |
|---|---|---|---|---|---|---|---|---|---|---|---|---|
| | L/L | N/N | H/H | L/L | N/N | H/H | L/L | N/N | H/H | L/L | N/N | H/H |
| Example 1 | 1.52 | 1.50 | 1.48 | 4.2 | 3.8 | 4.5 | 4.4 | 4.5 | 4.2 | A | A | A |
| Example 2 | 1.50 | 1.49 | 1.47 | 4.6 | 5.2 | 5.9 | 4.8 | 5.8 | 6.0 | A | A | A |
| Example 3 | 1.52 | 1.50 | 1.50 | 4.8 | 6.1 | 8.9 | 5.1 | 6.1 | 6.5 | A | A | A |
| Example 4 | 1.44 | 1.42 | 1.40 | 3.1 | 3.0 | 2.8 | 3.8 | 3.5 | 3.2 | A | A | A |
| Example 5 | 1.50 | 1.48 | 1.48 | 4.9 | 4.6 | 4.2 | 8.7 | 4.9 | 4.6 | A | A | A |
| Example 6 | 1.51 | 1.47 | 1.48 | 4.5 | 4.6 | 4.3 | 5.1 | 4.8 | 4.5 | B | A | A |
| Example 7 | 1.51 | 1.50 | 1.47 | 4.5 | 4.3 | 4.1 | 8.5 | 4.6 | 4.5 | A | A | A |
| Example 8 | 1.51 | 1.49 | 1.47 | 4.8 | 4.5 | 4.4 | 8.1 | 4.5 | 4.5 | A | A | A |
| Example 9 | 1.53 | 1.51 | 1.51 | 4.7 | 4.3 | 4.4 | 7.9 | 4.9 | 4.8 | A | A | A |
| Example 10 | 1.52 | 1.51 | 1.49 | 4.6 | 4.4 | 4.2 | 4.6 | 4.6 | 4.4 | A | A | A |
| Example 11 | 1.51 | 1.49 | 1.48 | 5.8 | 6.5 | 7.5 | 6.2 | 6.8 | 6.9 | A | A | A |
| Example 12 | 1.52 | 1.52 | 1.52 | 3.2 | 3.5 | 3.8 | 4.5 | 3.9 | 4.3 | A | A | A |

TABLE 7-continued

| | Image density | | | Fog Density after formation of white solid image (%) | | | Fog Density after formation of black solid image (%) | | | Insufficient control | | |
|---|---|---|---|---|---|---|---|---|---|---|---|---|
| | L/L | N/N | H/H | L/L | N/N | H/H | L/L | N/N | H/H | L/L | N/N | H/H |
| Example 13 | 1.42 | 1.40 | 1.40 | 8.1 | 8.9 | 9.1 | 7.9 | 8.6 | 9.4 | A | A | A |
| Example 14 | 1.40 | 1.38 | 1.39 | 4.2 | 4.2 | 4.5 | 4.3 | 4.4 | 4.8 | B | B | A |
| Example 15 | 1.48 | 1.45 | 1.44 | 4.6 | 4.6 | 4.8 | 4.9 | 4.8 | 4.9 | A | A | A |
| Example 16 | 1.54 | 1.52 | 1.52 | 5.1 | 5.0 | 5.5 | 5.3 | 5.2 | 6.5 | A | A | A |
| Example 17 | 1.51 | 1.50 | 1.48 | 4.5 | 4.7 | 4.5 | 4.6 | 4.7 | 4.4 | B | A | A |
| Example 18 | 1.53 | 1.51 | 1.51 | 4.8 | 6.5 | 9.4 | 5.2 | 5.5 | 6.7 | A | A | A |
| Example 19 | 1.51 | 1.50 | 1.47 | 4.8 | 5.6 | 6.8 | 4.6 | 5.9 | 5.9 | A | A | A |
| Example 20 | 1.52 | 1.50 | 1.49 | 4.6 | 6.2 | 9.4 | 4.9 | 5.8 | 6.0 | A | A | A |
| Example 21 | 1.49 | 1.45 | 1.45 | 6.2 | 6.8 | 7.0 | 8.7 | 9.1 | 9.7 | A | A | A |
| Example 22 | 1.50 | 1.48 | 1.48 | 4.8 | 4.5 | 4.5 | 9.2 | 5.8 | 5.2 | A | A | A |
| Comparative Example 1 | 1.49 | 1.48 | 1.48 | 4.8 | 4.5 | 4.4 | 18.0 | 8.2 | 4.9 | C | A | A |
| Comparative Example 2 | 1.51 | 1.49 | 1.47 | 9.8 | 14.2 | 39.2 | 11.5 | 14.2 | 15.8 | A | A | A |
| Comparative Example 3 | 0.78 | 0.71 | 0.61 | 3.4 | 3.8 | 4.9 | 3.1 | 3.5 | 4.1 | A | A | A |
| Comparative Example 4 | 1.53 | 1.50 | 1.47 | 7.8 | 10.5 | 32.1 | 8.9 | 8.6 | 10.2 | A | A | A |
| Comparative Example 5 | 0.89 | 0.81 | 0.72 | 5.4 | 8.0 | 10.5 | 6.8 | 9.9 | 14.0 | A | A | A |
| Comparative Example 6 | 1.51 | 1.49 | 1.46 | 8.8 | 12.4 | 38.9 | 9.1 | 10.0 | 10.7 | A | A | A |
| Comparative Example 7 | 1.51 | 1.49 | 1.47 | 5.2 | 5.1 | 5.0 | 24.2 | 8.4 | 5.2 | C | A | A |
| Comparative Example 8 | 1.53 | 1.52 | 1.49 | 5.4 | 5.2 | 4.9 | 23.8 | 7.9 | 5.6 | C | A | A |

TABLE 8

| | Formation of white solid image Q/M (mC/kg) | | | Formation of black solid image Q/M (mC/kg) | | |
|---|---|---|---|---|---|---|
| | L/L | N/N | H/H | L/L | N/N | H/H |
| Example 1 | 24 | 17 | 8 | 16 | 13 | 8 |
| Example 2 | 26 | 19 | 7 | 15 | 13 | 8 |
| Example 3 | 24 | 15 | 7 | 15 | 12 | 8 |
| Example 4 | 25 | 18 | 8 | 17 | 13 | 8 |
| Example 5 | 30 | 22 | 10 | 12 | 14 | 10 |
| Example 6 | 36 | 24 | 10 | 18 | 15 | 10 |
| Example 7 | 28 | 19 | 9 | 14 | 18 | 9 |
| Example 8 | 29 | 22 | 10 | 13 | 18 | 9 |
| Example 9 | 26 | 18 | 8 | 12 | 14 | 8 |
| Example 10 | 24 | 16 | 8 | 14 | 13 | 8 |
| Example 11 | 25 | 18 | 8 | 16 | 14 | 9 |
| Example 12 | 35 | 25 | 10 | 24 | 18 | 10 |
| Example 13 | 20 | 14 | 8 | 14 | 12 | 8 |
| Example 14 | 38 | 25 | 10 | 22 | 19 | 11 |
| Example 15 | 22 | 16 | 8 | 15 | 11 | 8 |
| Example 16 | 29 | 19 | 8 | 18 | 14 | 9 |
| Example 17 | 35 | 23 | 9 | 20 | 17 | 10 |
| Example 18 | 23 | 15 | 8 | 16 | 12 | 8 |
| Example 19 | 22 | 14 | 9 | 15 | 13 | 9 |
| Example 20 | 22 | 13 | 8 | 15 | 12 | 8 |
| Example 21 | 25 | 17 | 8 | 17 | 14 | 8 |
| Example 22 | 26 | 18 | 10 | 11 | 13 | 9 |
| Comparative Example 1 | 42 | 19 | 8 | 8 | 11 | 8 |
| Comparative Example 2 | 22 | 15 | 6 | 17 | 11 | 8 |
| Comparative Example 3 | 22 | 16 | 8 | 17 | 12 | 8 |
| Comparative Example 4 | 22 | 14 | 5 | 14 | 11 | 7 |
| Comparative Example 5 | 25 | 16 | 7 | 16 | 14 | 9 |
| Comparative Example 6 | 24 | 18 | 5 | 17 | 13 | 8 |
| Comparative Example 7 | 46 | 25 | 11 | 7 | 11 | 9 |
| Comparative Example 8 | 44 | 23 | 11 | 7 | 12 | 8 |

In Examples 1 to 22, the results are good. In Comparative Examples 2, 4, and 6, the covering rates are low, charges of the toner are escaped from the developing rollers, and fogging is increased under H/H environments probably because the coverage portions have low resistance.

In Comparative Examples 7 and 8, the toners have low fluidity. The toners cannot be entirely strongly charged, and the charge amounts Q/M do not rise after consumption of the toners, increasing fogging after formation of a black solid image. Furthermore, the toners have low fluidity, and only the toners contacting the developing roller are charged, resulting in insufficient control in some cases.

In Comparative Examples 3 and 5, voltage is not sufficiently applied to the developing rollers due to the thick coverage portions, reducing the image densities.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-269605, filed Dec. 26, 2013, which is hereby incorporated by reference herein in its entirety.

What is claimed is:

1. A developing apparatus comprising:

a toner comprising a binder resin, colorant and 0.40-1.50 parts by mass silica fine particles based on 100 parts by mass of the toner particles;

a developing container accommodating the toner;

a rotatably held developing roller that carries toner fed from the developing container on the surface of the developing roller to form a toner layer and convey the toner, the developing roller comprising a substrate having a base layer disposed on an outer peripheral surface of the substrate and a coverage portion disposed on an outer periphery of the base layer, the coverage portion having a volume resistivity of at least $1.0\times10^{8}$ Ω·cm and an average thickness of 0.3 to 5.0 μm; and a toner layer thickness controlling member controlling the thickness of the toner layer, wherein diffusion index $X1/X2 \geq -0.0042\times X1+0.62$ where theoretical coverage rate with all the silica particles contained in the toner X2 (area %)$=3^{1/2}/(2\pi)\times(dt/da)\times(\rho t/\rho a)\times C\times100$, da is number average particle diameter (D1) of primary particles of the silica fine particles, dt is mass average particle diameter (D4) of the toner, ρa is true specific gravity of the silica fine particles, ρt is true specific gravity of the toner, C is mass of the silica fine particles/mass of the toner, and a covering rate X1 of the surface of each of the toner particles with the silica fine particles is 40.0-75.0 area % as determined by observing the toner with an X-ray electron spectroscope for chemical analysis (ESCA).

2. The developing apparatus according to claim 1, wherein the coverage portion contains at least one resin selected from the group consisting of a urethane resin, a silicone resin, a carbonate resin, a polyester resin, an acrylic resin, and a polyolefin resin.

3. The developing apparatus according to claim 1, wherein the coverage portion contains alumina.

4. The developing apparatus according to claim 1, wherein the coverage portion has a volume resistivity of at least $1.0\times10^{12}$ Ω·cm and contains at least one resin selected from the group consisting of a urethane resin, a silicone resin, a carbonate resin, a polyester resin, an acrylic resin, and a polyolefin resin.

5. The developing apparatus according to claim 4, wherein the volume resistivity of the coverage portion is $1.0\times10^{13}$ Ω·cm or more.

6. The developing apparatus according to claim 1, wherein the coverage portion contains alumina, and has a volume resistivity of $1.0\times10^{10}$ Ω·cm or more.

7. The developing apparatus according to claim 6, wherein the volume resistivity of the coverage portion is $5.0\times10^{10}$ Ω·cm or more.

8. The developing apparatus according to claim 1, wherein the coverage portion is disposed over at least 30.0 area % or more of a layer disposed immediately under the coverage portion.

9. The developing apparatus according to claim 1, wherein the developing roller includes at least one intermediate layer between the base layer and the coverage portion, and the intermediate layer contains at least a resin, an electro-conductive particle, and a roughening particle.

10. A developing method using the developing apparatus according to claim 1, the method comprising a step of contacting the developing roller with a region to be developed in which the developing roller faces an electrophotographic photosensitive member, conveying the toner, and developing an electrostatic latent image with the toner, the electrostatic latent image being formed on the electrophotographic photosensitive member.

11. An image forming method, comprising the steps of:

(1) charging the surface of an electrophotographic photosensitive member;

(2) irradiating the charged surface of the electrophotographic photosensitive member with image exposing light to form an electrostatic latent image on the surface of the electrophotographic photosensitive member;

(3) developing the electrostatic latent image formed on the surface of the electrophotographic photosensitive member to form a toner image on the surface of the electrophotographic photosensitive member;

(4) transferring the toner image formed on the surface of the electrophotographic photosensitive member onto a transfer material with or without an intermediate transferring member; and (5) fixing the toner image transferred onto the transfer material on the transfer material, wherein step (3) is performed according to developing method according to claim 10.

12. An image forming apparatus comprising:

an electrophotographic photosensitive member;

a charging unit charging the surface of the electrophotographic photosensitive member;

an image exposure unit irradiating the charged surface of the electrophotographic photosensitive member with image exposing light to form an electrostatic latent image on the surface of the electrophotographic photosensitive member;

a developing unit developing the electrostatic latent image formed on the surface of the electrophotographic photosensitive member to form a toner image on the surface of the electrophotographic photosensitive member;

a transfer unit transferring the toner image formed on the surface of the electrophotographic photosensitive member onto a transfer material with or without an intermediate transferring member; and a fixing unit fixing the toner image transferred onto the transfer material on the transfer material, wherein the developing unit is the developing apparatus according to claim 1.

* * * * *